US012065300B2

(12) United States Patent
Gayakwad et al.

(10) Patent No.: US 12,065,300 B2
(45) Date of Patent: Aug. 20, 2024

(54) RECONFIGURABLE PACKAGING AND CORRESPONDING BLANK

(71) Applicant: WHIRLPOOL CORPORATION, Benton Harbor, MI (US)

(72) Inventors: Sachin R. Gayakwad, Pune (IN); Tushar A. Kalbande, Pune (IN); Jessica Lea Kormanik, St. Joseph, MI (US); Renuka D. Niphadkar, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 18/212,421

(22) Filed: Jun. 21, 2023

(65) Prior Publication Data

US 2023/0331456 A1 Oct. 19, 2023

Related U.S. Application Data

(63) Continuation of application No. 17/532,951, filed on Nov. 22, 2021, now Pat. No. 11,724,867.

(51) Int. Cl.
*B65D 81/127* (2006.01)
*B65D 5/50* (2006.01)
(Continued)

(52) U.S. Cl.
CPC ..... *B65D 81/127* (2013.01); *B65D 5/5052* (2013.01); *B65D 85/68* (2013.01);
(Continued)

(58) Field of Classification Search
CPC ..... B65D 5/50; B65D 5/5052; B65D 81/127; B65D 85/68; B65D 2585/682; F24C 7/10; F24C 15/16
(Continued)

(56) References Cited

U.S. PATENT DOCUMENTS 1,930,896 A 10/1933 Hause
2,177,241 A 10/1939 Burack
(Continued)

FOREIGN PATENT DOCUMENTS

DE 1113413 B 8/1961
DE 29508475 U1 8/1995
WO 2018130842 A1 7/2018

OTHER PUBLICATIONS

CN 210654494 U, Packaging Structure for Cooking Device (Year: 2020).*

(Continued)

*Primary Examiner* — Bryon P Gehman
(74) *Attorney, Agent, or Firm* — Price Heneveld LLP

(57) ABSTRACT

Reconfigurable packaging for a cooking appliance includes a base including a base panel defining lower wing slots and opposing sidewalls extending from the base panel. The base defines a storage cavity. A cover is coupled to the base and configured to enclose the storage cavity. The cover includes a cover panel defining upper wing slots, a first side wing extending from a first side of the cover panel, and a second side wing extending from a second side of the cover panel. The first side wing and the second side wing are operable between a first folded position engaging the upper wing slots and a second folded position engaging the lower wing slots.

20 Claims, 18 Drawing Sheets

(51) Int. Cl.

| | |
|---|---|
| ***B65D 85/68*** | (2006.01) |
| ***F24C 7/10*** | (2021.01) |
| ***F24C 15/16*** | (2006.01) |

(52) U.S. Cl.
CPC ..... *F24C 7/10* (2013.01); *F24C 15/16* (2013.01); *B65D 2585/682* (2013.01)

(58) Field of Classification Search
USPC ..... 206/320; 229/101, 103
See application file for complete search history.

(56) References Cited

U.S. PATENT DOCUMENTS

| | | | |
|---|---|---|---|
| 3,150,812 | A | 9/1964 | Sabol |
| 3,194,477 | A | 7/1965 | Blumberg |
| 3,598,303 | A | 8/1971 | Folz |
| 5,786,580 | A | 7/1998 | Yeo |
| 5,873,459 | A | 2/1999 | Yeo |
| 9,932,163 | B2 | 4/2018 | Nishijima |
| 10,359,226 | B2 | 7/2019 | Giacomini et al. |
| 10,400,443 | B2 | 9/2019 | Sollie et al. |

OTHER PUBLICATIONS

CN 211810689 U Packaging Assembly for Kitchen Electric Appliance (Year: 2020).*

* cited by examiner

RECONFIGURABLE PACKAGING AND CORRESPONDING BLANK

CROSS-REFERENCE TO RELATED APPLICATION

This application is a continuation of U.S. patent application Ser. No. 17/532,951, filed on Nov. 22, 2021, now U.S. Pat. No. 11,724,867, entitled "RECONFIGURABLE PACKAGING AND CORRESPONDING BLANK," the disclosure to which is hereby incorporated herein by reference in its entirety.

BACKGROUND OF THE DISCLOSURE

The present disclosure generally relates to reconfigurable packaging, and more specifically, to reconfigurable packaging and the corresponding blank to form the reconfigurable packaging.

SUMMARY OF THE DISCLOSURE

According to one aspect of the present disclosure, reconfigurable packaging for a cooking appliance includes a base including a base panel defining lower wing slots and opposing sidewalls extending from the base panel. The base defines a storage cavity. A cover is coupled to the base and configured to enclose the storage cavity. The cover includes a cover panel defining upper wing slots, a first side wing extending from a first side of the cover panel, and a second side wing extending from a second side of the cover panel. The first side wing and the second side wing are operable between a first folded position engaging the upper wing slots and a second folded position engaging the lower wing slots.

According to another aspect of the present disclosure, a blank for reconfigurable packaging includes a base portion configured to form a base of the reconfigurable packaging. The base portion includes a base panel defining sidewall slots and base wing slots, a first side extension extending from a first side of the base panel, and a second side extension extending from a second opposing side of the base panel. A cover portion is configured to form a cover of the reconfigurable packaging. The cover portion includes a cover panel defining cover wing slots, a first wing flap extending from a first side of the cover panel and including a first distal tab, and a second wing flap extending from a second side of the cover panel and including a second distal tab. Each of the first wing flap and the second wing flap are configured to be folded into a first folded position along at least one of a crease and a perforated line for the distal tabs to engage the cover wing slots and a second folded position along at least one of a crease and a perforated line for the first and second distal tabs to engage the base wing slots. A connector portion coupling the base panel and the cover panel.

According to yet another aspect of the present disclosure, a method for adjusting a packaging size providing a blank, folding the blank to form sidewalls of a base, folding the blank to form a cover configured to enclose a storage cavity formed by the base, folding side wings of the cover toward the base, folding the side wings into a first folded position where engagement portions of the side wings extend toward the cover to insert distal tabs in upper wing slots defined by the cover to define a first width of a packaging, and folding the side wings into a second folded position where the engagement portions of the side wings extend along a bottom surface of the base to insert the distal tabs in base wing slots defined by the base to define a second width of the packaging.

These and other features, advantages, and objects of the present disclosure will be further understood and appreciated by those skilled in the art by reference to the following specification, claims, and appended drawings.

Figure 1:
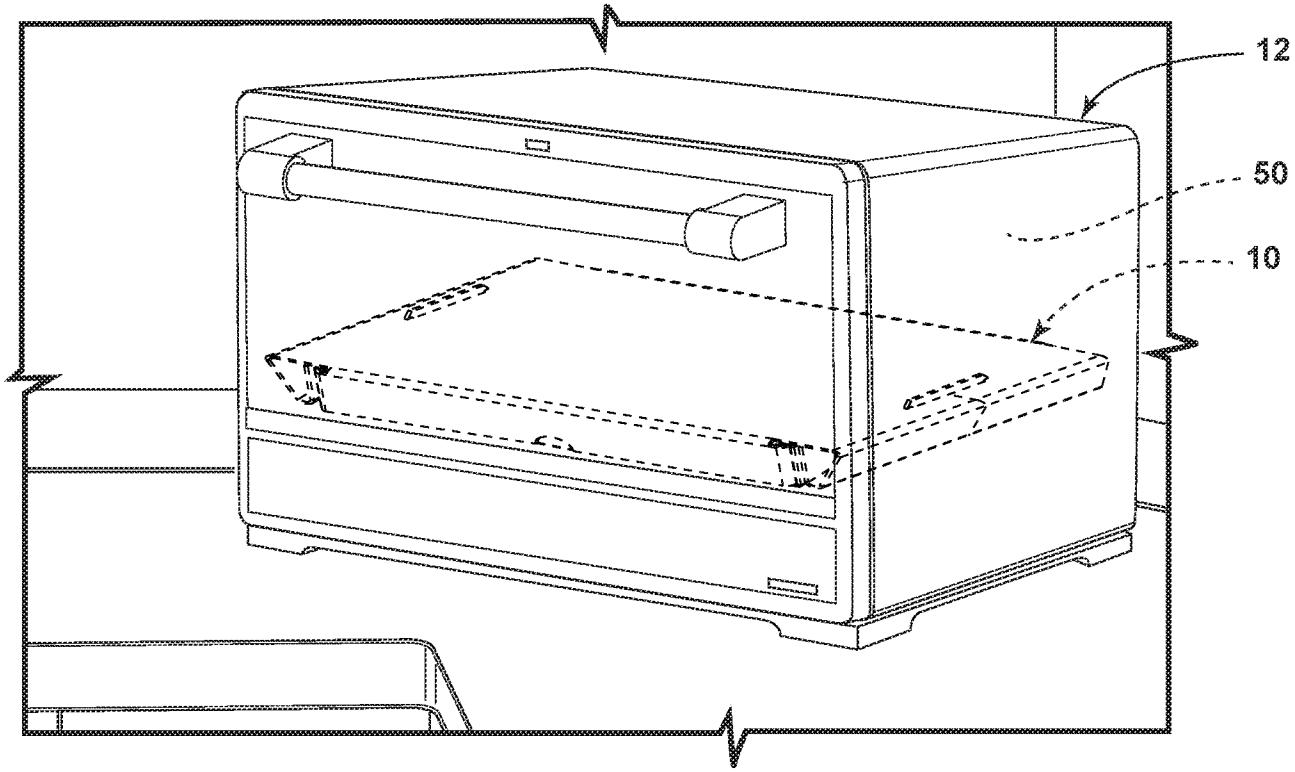
FIG. 1 is a front perspective view of a countertop appliance with packaging shown in phantom in a cooking cavity, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to reconfigurable packaging and corresponding blank. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

With reference to FIGS. 1-19, reference numeral 10 generally designates reconfigurable packaging 10 for a cooking appliance 12 with a base 14 that includes a base panel 16 defining lower wing slots 18 and opposing sidewalls 20, 22 extending from the base panel 16. The base 14 defines a storage cavity 24. A cover 26 is coupled to the base 14 and configured to enclose the storage cavity 24. The cover 26 includes a cover panel 28 defining upper wing slots 30. A first side wing 32 extends from a first side of the cover panel 28. A second side wing 34 extends from a second side of the cover panel 28. The first side wing 32 and the second side wing 34 are operable between a first folded position 36 engaging the upper wing slots 30 and a second folded position 38 engaging the lower wing slots 18.

Figure 2:
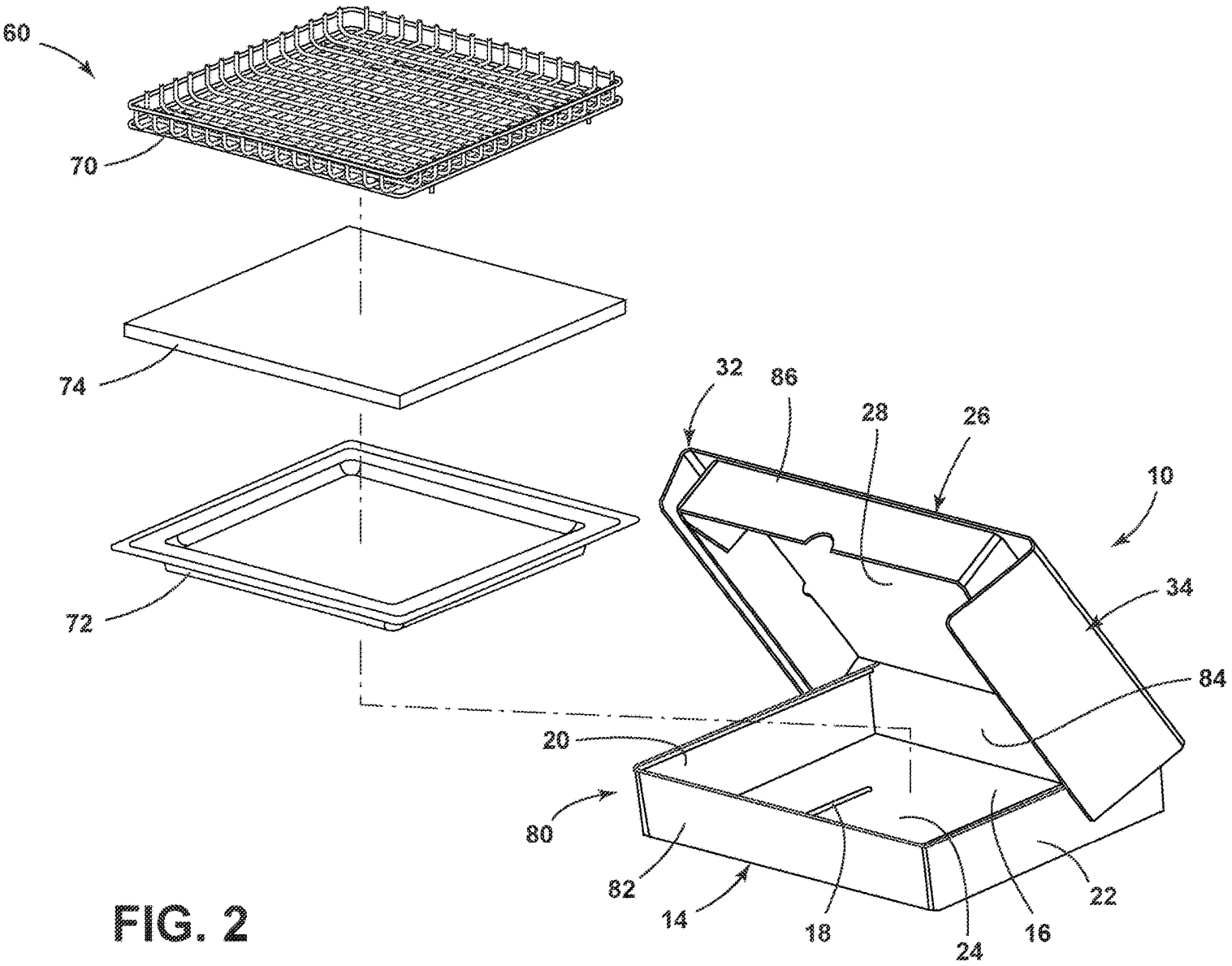
FIG. 2 is a front perspective exploded view of appliance accessories and packaging to hold the appliance accessories, according to the present disclosure.
Figure 3:
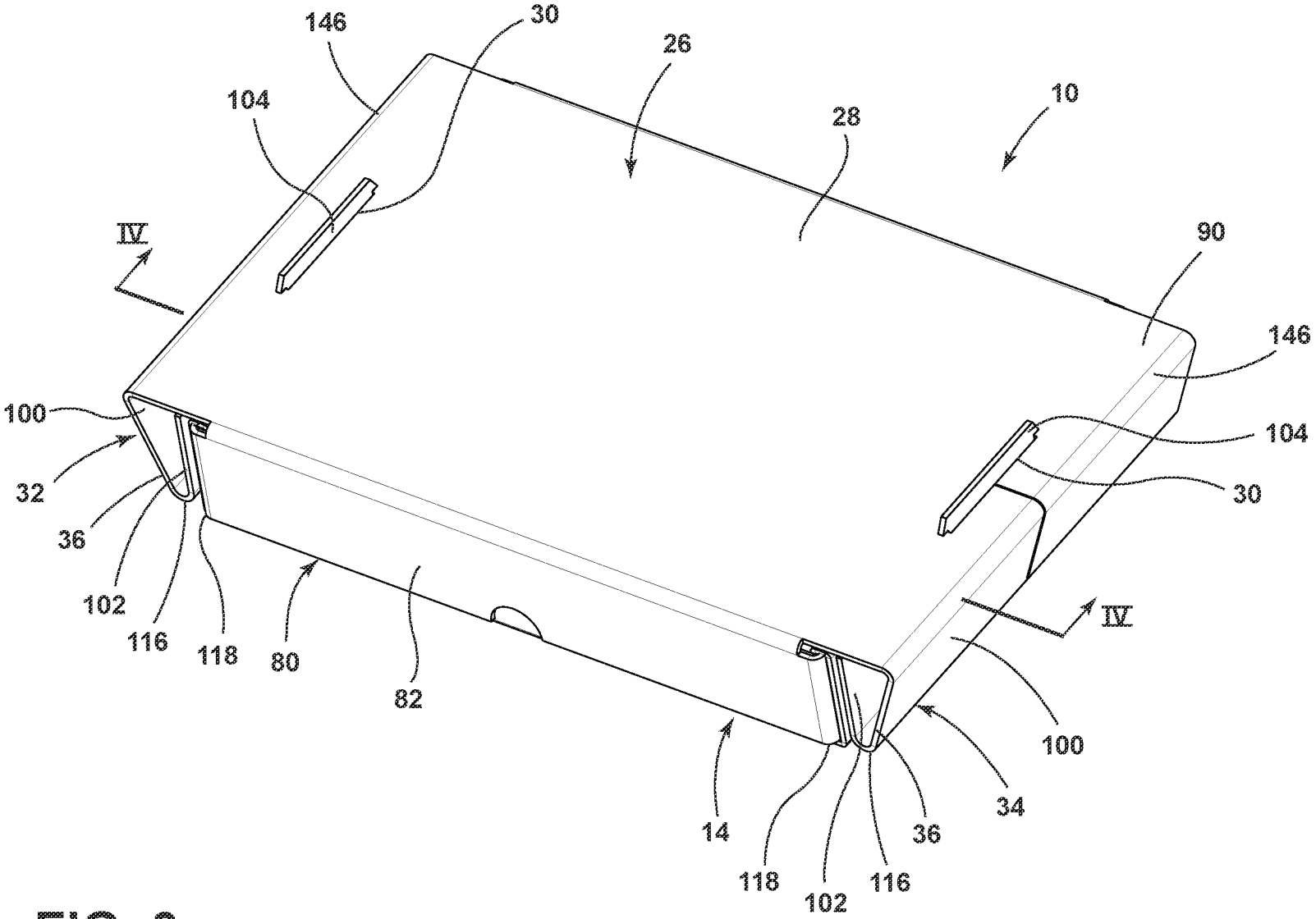
FIG. 3 is a top perspective view of reconfigurable packaging in a first configuration with side wings in a first folded position, according to the present disclosure.

With reference to FIGS. 1 and 2, the cooking appliance 12 is illustrated with the packaging 10 disposed within a cooking cavity 50 thereof. Different cooking appliances 52, 54 (FIGS. 9 and 15), which are collectively referred to herein as the cooking appliance 12, may have different sized cooking cavities 56, 58 (FIGS. 9 and 15), which are collectively referred to herein as the cooking cavity 50. The cooking appliance 12 is illustrated as a countertop cooking appliance 12; however, the packaging 10 may be utilized with any cooking appliance 12 or other household or commercial appliance without departing from the teachings herein.

Generally, the packaging 10 may be disposed within the cooking cavity 50 of the cooking appliance 12 during a shipping process. The packaging 10 often stores various accessories 60 for the cooking appliance 12 to protect the accessories 60 during the shipping process. The accessories 60 are placed within the packaging 10, the packaging 10 is placed within the cooking appliance 12, and the cooking appliance 12 may then be placed into a shipping package.

With reference still to FIG. 2, the packaging 10 defines the storage cavity 24 configured to hold or store the accessories 60 during the shipping process of the cooking appliance 12. In the illustrated example of FIG. 2, the accessories 60 include a basket 70 and a tray 72. Each of the basket 70 and tray 72 may be slightly smaller in length and width than the storage cavity 24 to prevent substantial movement of the accessories 60 within the packaging 10 during the shipping process. The basket 70 and the tray 72 may be separated by an insert 74, which may be constructed of support materials such as cardboard, plastic, foam, etc. The insert 74 may minimize or prevent contact between the basket 70 and the tray 72 while the accessories 60 are disposed within the packaging 10.

The accessories 60 are generally stacked on one another, separated by the insert 74, and disposed within the storage cavity 24 on the base panel 16. Additional or alternative accessories 60 may be disposed within the packaging 10 without departing from the teachings herein. Further, additional or alternative inserts 74, supports, or other features to hold the accessories 60 may be utilized depending on the size and shape of the accessories 60 within the packaging 10.

Referring still to FIG. 2, the packaging 10 includes the base 14, which has the base panel 16 and a plurality of walls 80 extending from the base panel 16. The plurality of walls 80 extending from the base panel 16 includes the opposing sidewalls 20, 22, a front wall 82, and a rear wall 84. The walls 80 and the base panel 16 form the storage cavity 24 for the accessories 60.

The packaging 10 also includes the cover 26, which is coupled to the base 14 via the rear wall 84. The cover 26 includes the cover panel 28 and a front coupling insert 86, which extends from an opposing edge of the cover panel 28 relative to the rear wall 84. Additionally, the cover 26 includes the first and second side wings 32, 34 extending from the opposing sides of the cover panel 28.

With reference now to FIGS. 5-15, the packaging 10 is operable between a first configuration, where the first and second side wings 32, 34 are in the first folded position 36, and a second configuration 92, where the first and second side wings 32, 34 are in the second folded position 38. The packaging 10 defines a first width in the first configuration 90 and a second width in the second configuration 92, where the second width is less than the first width. The first and second side wings 32, 34 are operable or adjustable between the first and second folded positions 36, 38 to adjust the width of the packaging 10. The different widths are advantageous for utilizing the same packaging 10 in the cooking cavities 56, 58 of different sizes. The packaging 10 is configured to rest on a bottom 94 of the cooking cavity 50.

Generally, the packaging 10 is placed in a horizontal position, rather than at an angle within the cooking cavity 50. However, other configurations are contemplated without departing from the teachings herein.

Referring still to FIGS. 5-8, the packaging 10 is illustrated in the first configuration 90 where the side wings 32, 34 are in the first folded position 36. The first configuration 90 is generally an expanded configuration for the packaging 10 such that the packaging 10 has a greater width. In the first folded position 36, each of the first and second side wings 32, 34 are folded into triangular shapes adjacent to the respective sidewall, causing the increase in the width of the packaging 10.

When the first and second side wings 32, 34 are in the first folded position 36, the cover panel 28 extends beyond the sidewalls 20, 22 of the base 14. Each wing includes a connector portion 100, which extends from the cover panel 28, and an engagement portion 102, which extends from the connector portion 100. A distal tab 104 extends from each engagement portion 102. The cover panel 28 extending beyond the sidewalls 20, 22 provides additional space adjacent to the sidewalls 20, 22 for the side wings 32, 34 to form the triangular shapes. The connector portions 100 of the side wings 32, 34 extend at an angle $\alpha$ from side edges of the cover panel 28. Generally, the connector portions 100 extend at an acute angle $\alpha$ relative to an interior surface 106 of the cover panel 28.

Figure 7:
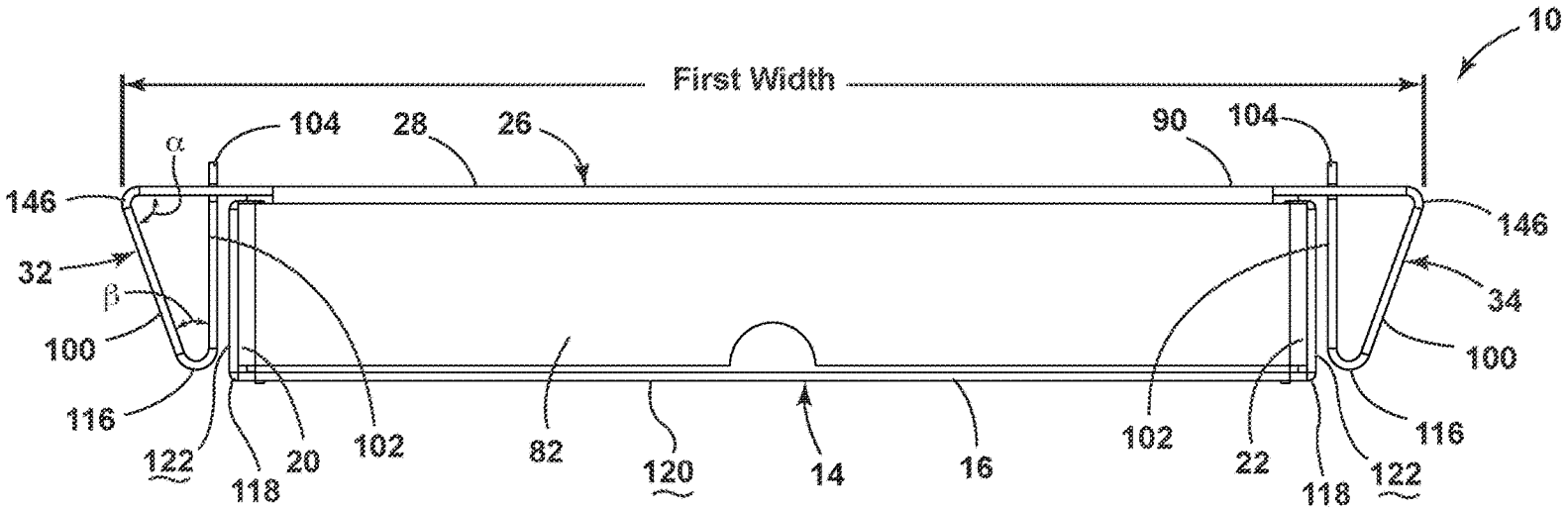
FIG. 7 is a front elevation view of reconfigurable packaging in a first configuration with side wings in a first folded position, according to the present disclosure.

When the cover 26 is closed, the connector portions 100 extend from the cover panel 28, down toward the base panel 16, and inward toward the adjacent sidewall 20, 22. The engagement portions 102 extend at an acute angle $\beta$ relative to the connector portions 100. The engagement portions 102 extend from the connector portions 100 and upward toward the cover panel 28, thereby forming the triangular shapes. Generally, a corner 116 defined between the connector portions 100 and the engagement portions 102 is disposed proximate a corner 118 defined between the base panel 16 and the sidewalls 20, 22. As best illustrated in FIG. 7, the corners 116 of the side wings 32, 34 are offset from the base panel 16 and do not extend beyond the base panel 16. In this configuration, the packaging 10 rests on a bottom surface 120 of the base panel 16 without interference from the side wings 32, 34 in the first folded position 36.

Referring still to FIGS. 5-8, the engagement portions 102 extend between the connector portions 100 and the sidewalls 20, 22, respectively. The engagement portions 102 extend along outer surfaces 122 of the sidewalls 20, 22 toward the interior surface 106 of the cover panel 28. The engagement portions 102 may extend proximate to, about, or abut the outer surfaces 122 of the sidewall 20, 22. The cover panel 28 defines the upper wing slots 30. The first side wing 32 is configured to engage one upper wing slot 30 and the second side wing 34 is configured to engage the other upper wing slot 30. The upper wing slots 30 are defined proximate to the respective side edge of the cover panel 28 and are slightly offset from the sidewalls 20, 22 of the base 14 when the cover 26 is closed.

Figure 6:
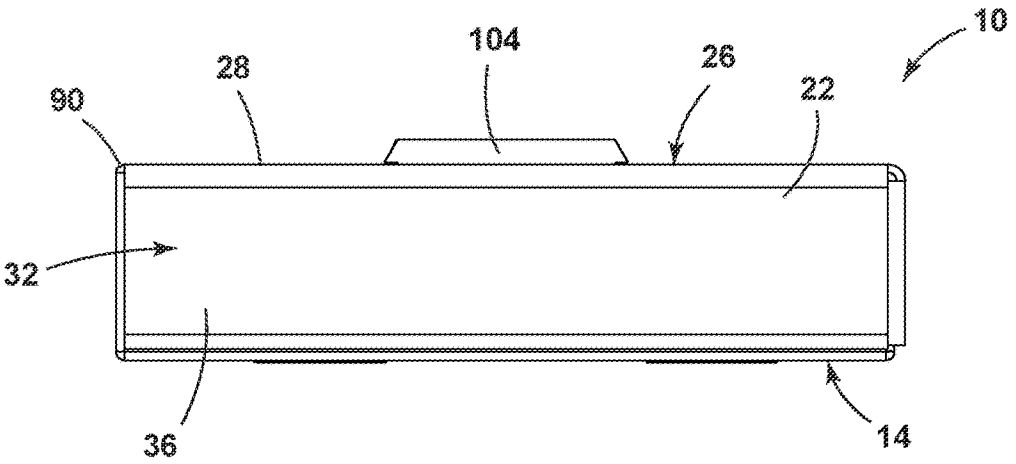
FIG. 6 is a side elevation view of reconfigurable packaging in a first configuration with side wings in a first folded position, according to the present disclosure.

The upper wing slots 30 are arranged wider than the base 14 to be defined on outside of the respective sidewalls 20, 22 of the base 14 to allow engagement with the side wings 32, 34 when the cover 26 is closed. The side wings 32, 34 are configured to fold down, in, and then up to insert the distal tabs 104 into or through the upper wing slots 30 to retain the side wings 32, 34 in the first folded position 36. The distal tabs 104 are generally wider than the upper wing slots 30. Accordingly, once inserted through the upper wing slots 30, the distal tabs 104 engage a top surface of the cover panel 28 to retain the side wings 32, 34 in the first folded position 36. In this way, the distal tabs 104 extend generally perpendicularly from the cover panel 28, as best illustrated in FIGS. 6 and 7.

Figure 4:
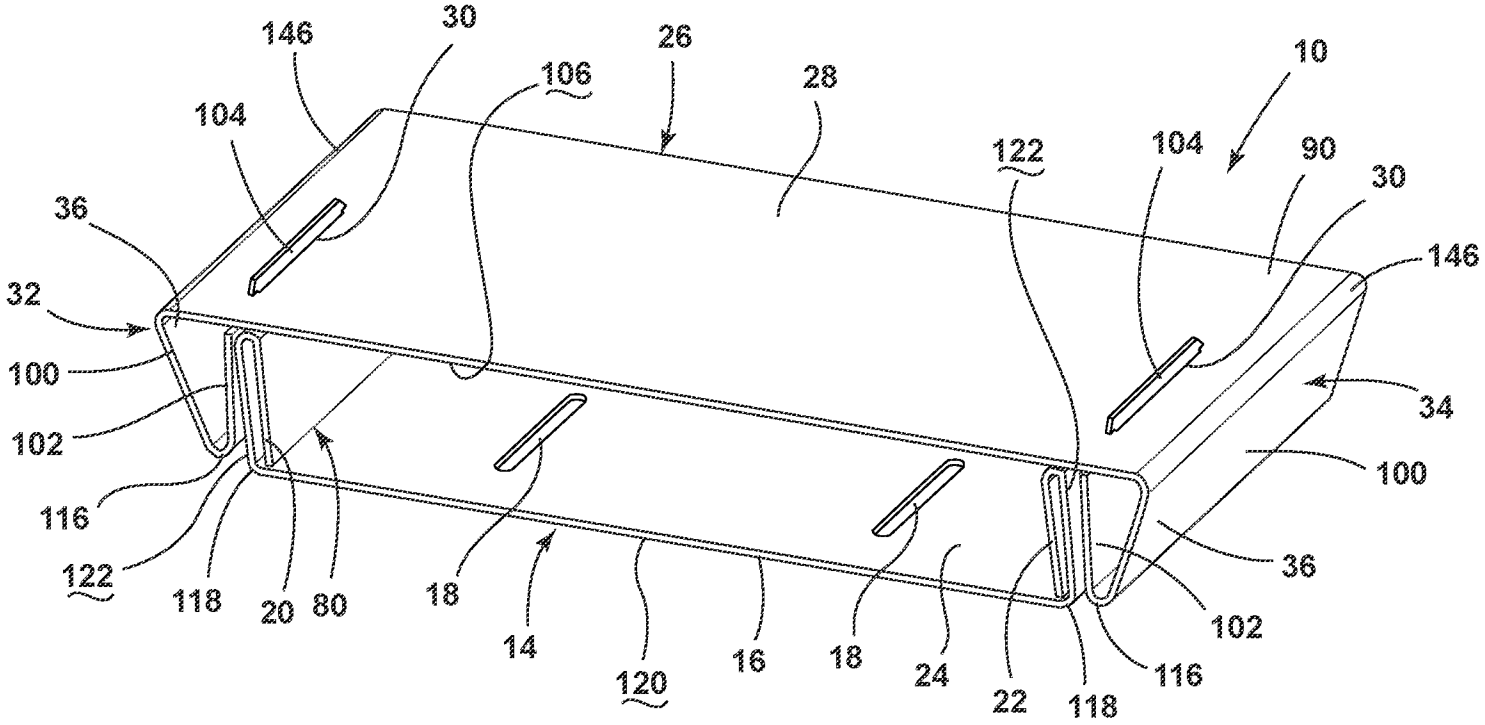
FIG. 4 is a top perspective cross-sectional view of the reconfigurable packaging of FIG. 3 taken along lines IV-IV, according to the present disclosure.
Figure 5:
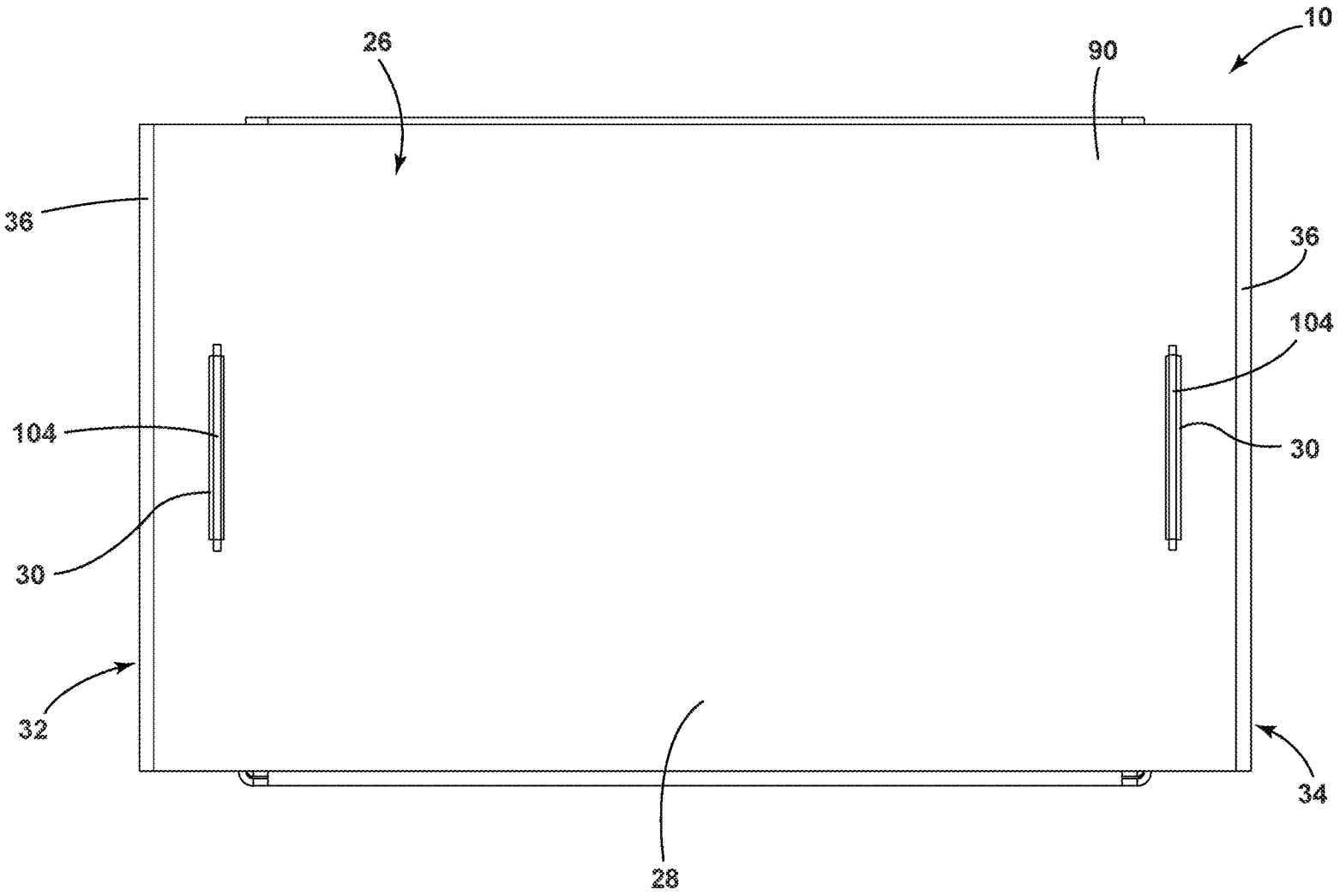
FIG. 5 is a top plan view of reconfigurable packaging in a first configuration with side wings in a first folded position, according to the present disclosure.
Figure 8:
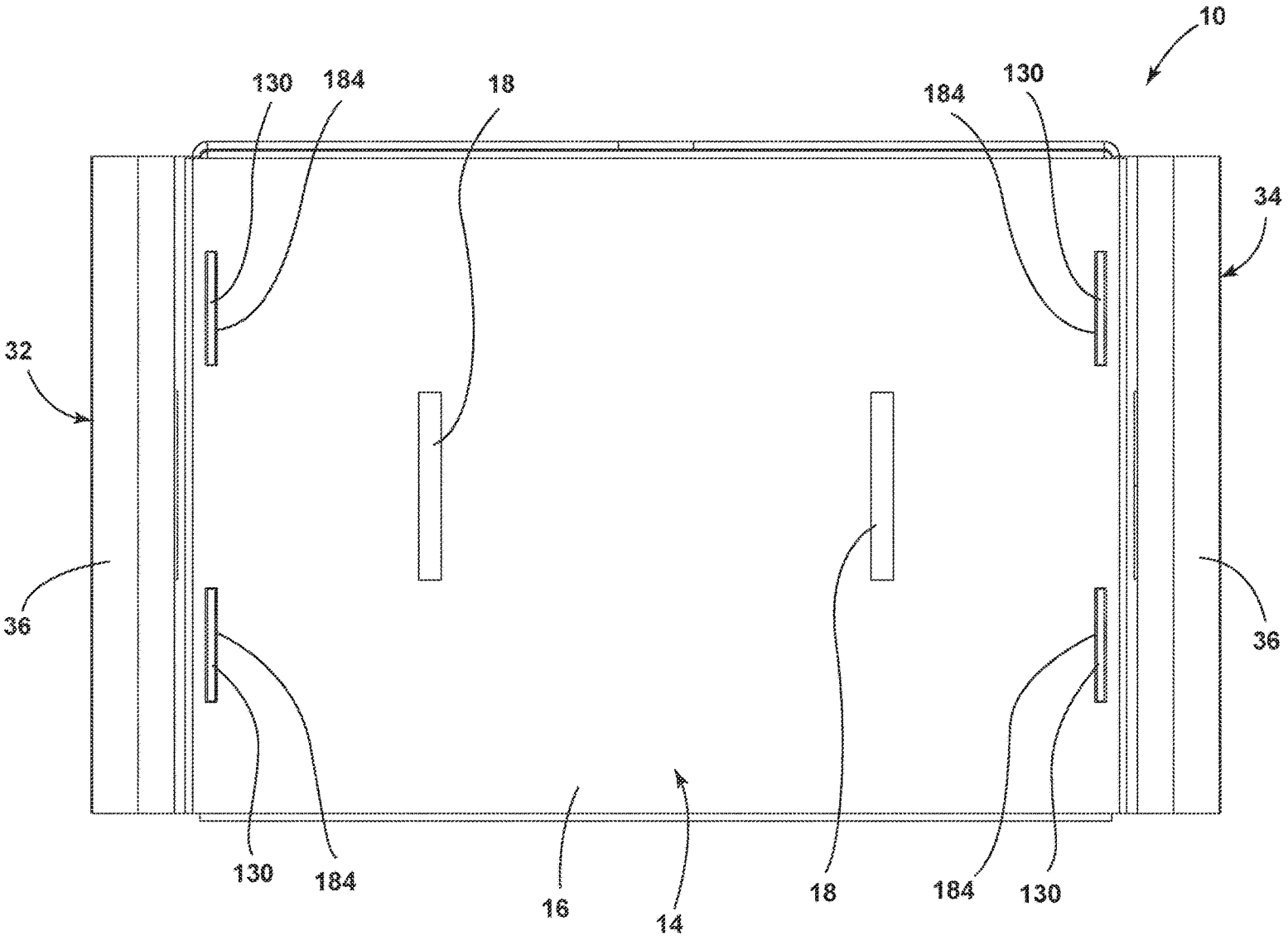
FIG. 8 is a bottom plan view of reconfigurable packaging in a first configuration with side wings in a first folded position, according to the present disclosure.

As best illustrated in FIGS. 4 and 8, the base panel 16 defines a plurality of slots. The base panel 16 defines sidewall slots 130 configured to retain the sidewalls 20, 22 in the folded position as described further herein. Additionally, the base panel 16 defines the lower wing slots 18. When the side wings 32, 34 are in the first folded position 36 forming the triangular shapes, the lower wing slots 18 remain as open apertures on the base panel 16.

Figure 9:
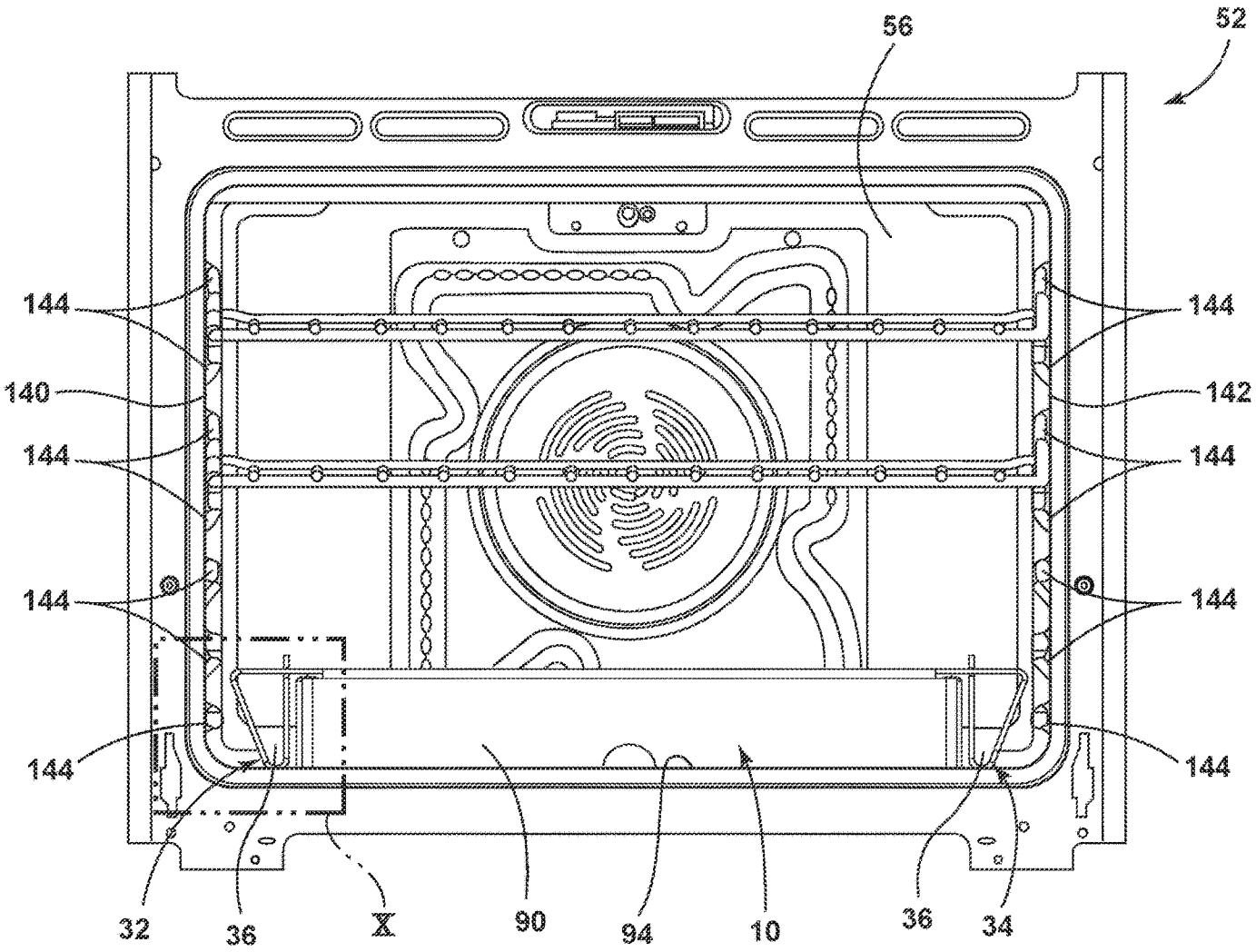
FIG. 9 is a front elevation view of reconfigurable packaging in a first configuration with side wings in a first folded position disposed within a cooking cavity, according to the present disclosure.
Figure 10:
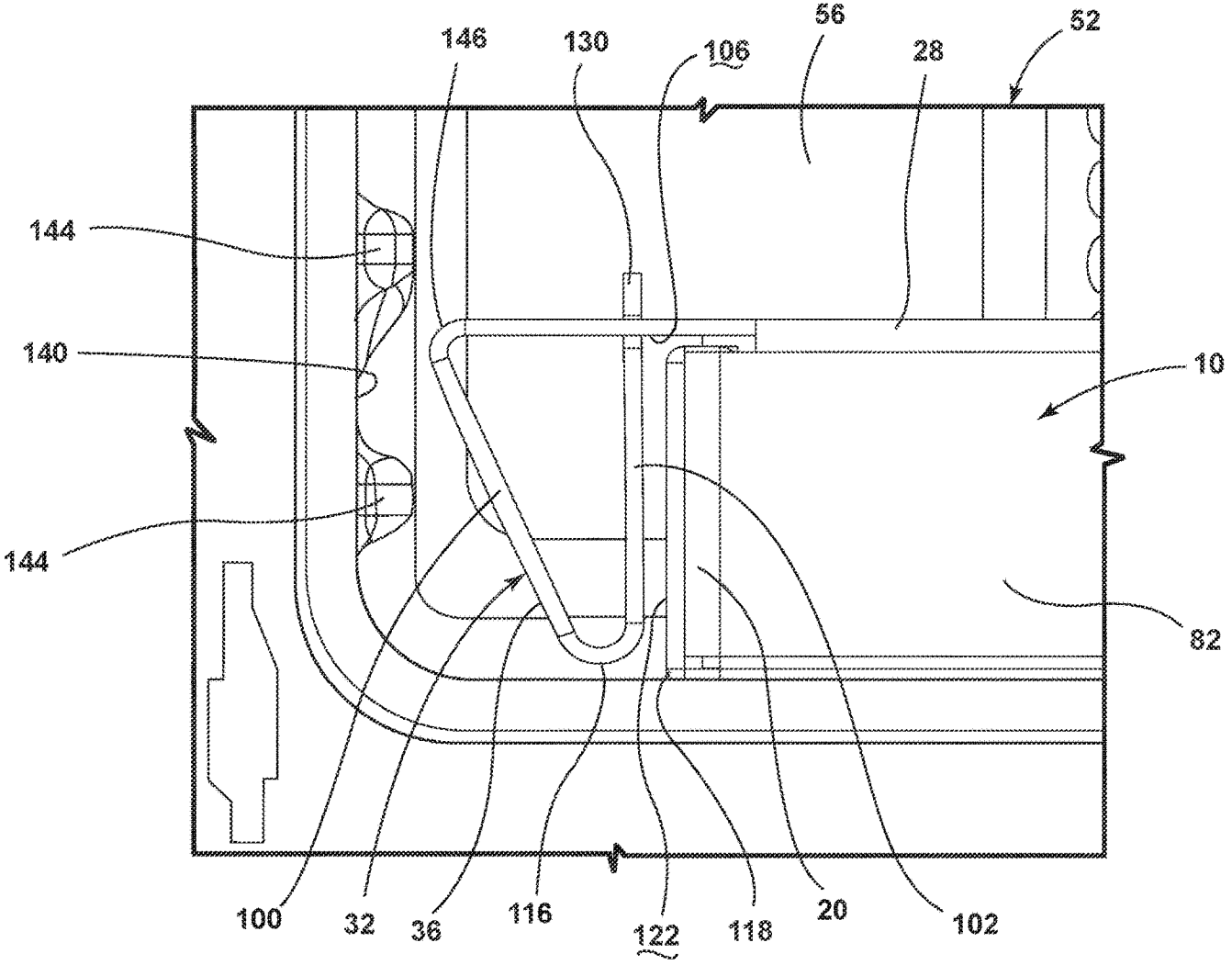
FIG. 10 is a partial enlarged front elevation view of a first wing of the reconfigurable packaging of FIG. 9 disposed adjacent to a sidewall, taken at area X, according to the present disclosure.
Figure 11:
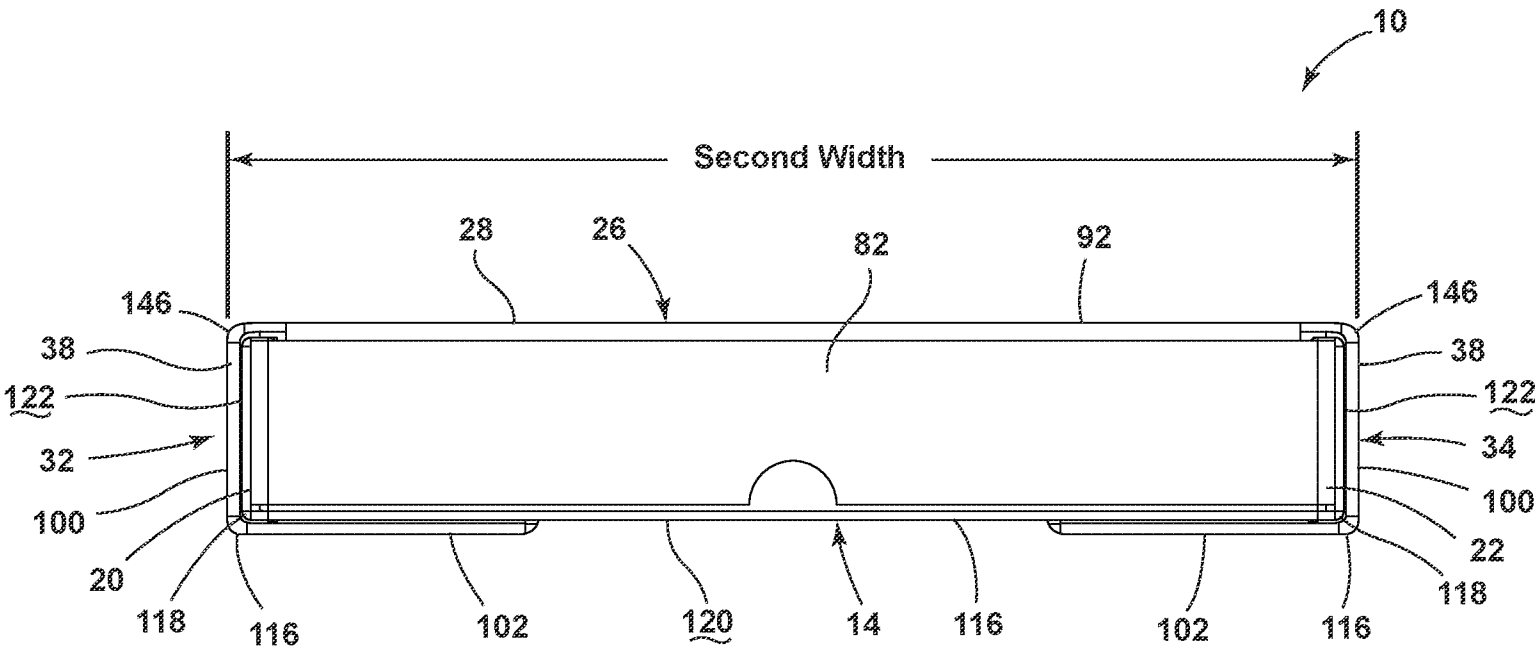
FIG. 11 is a front elevation view of reconfigurable packaging in a second configuration with side wings in a second folded position, according to the present disclosure.
Figure 12:
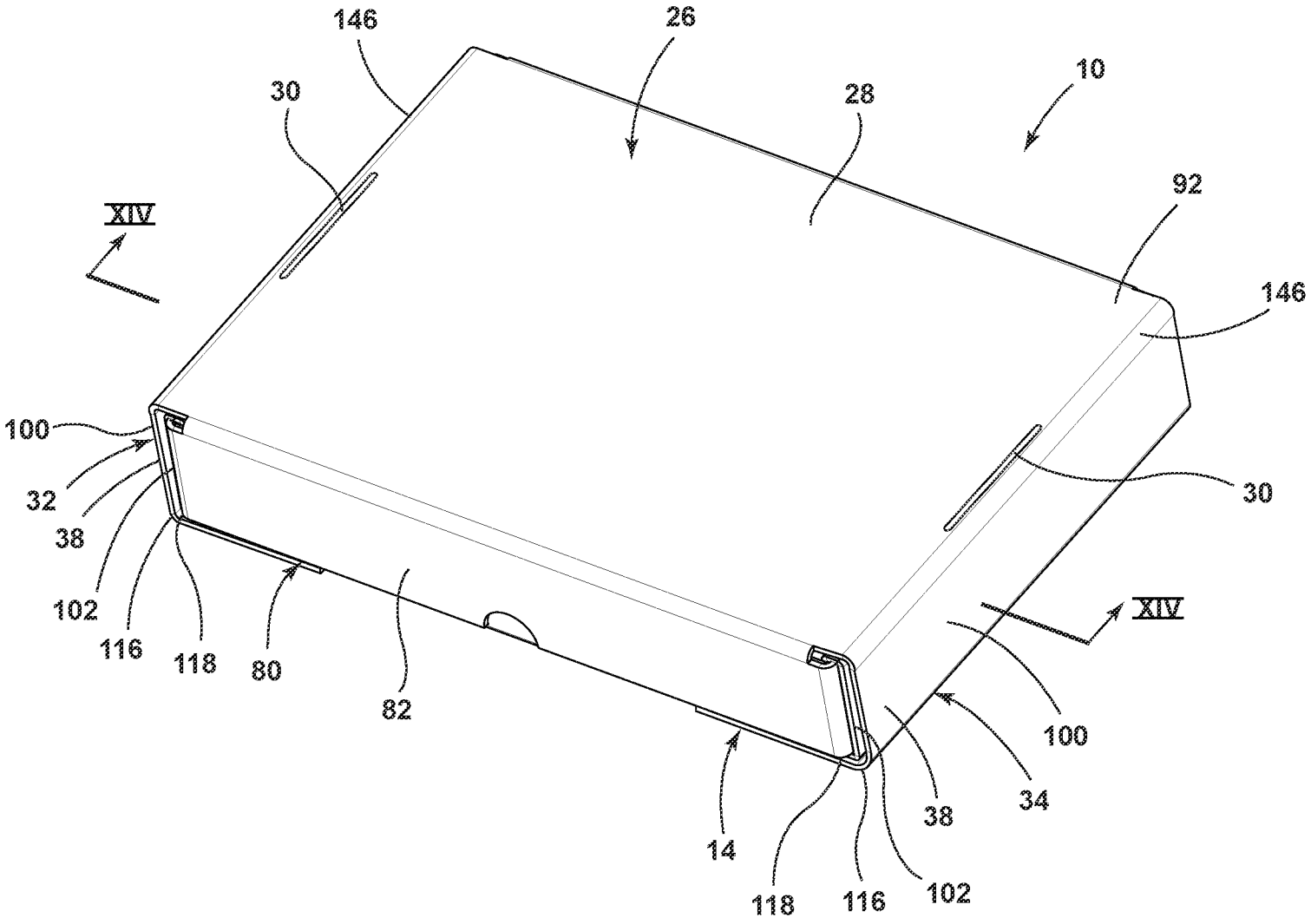
FIG. 12 is a top perspective view of reconfigurable packaging in a second configuration with side wings in a second folded position, according to the present disclosure.
Figure 13:
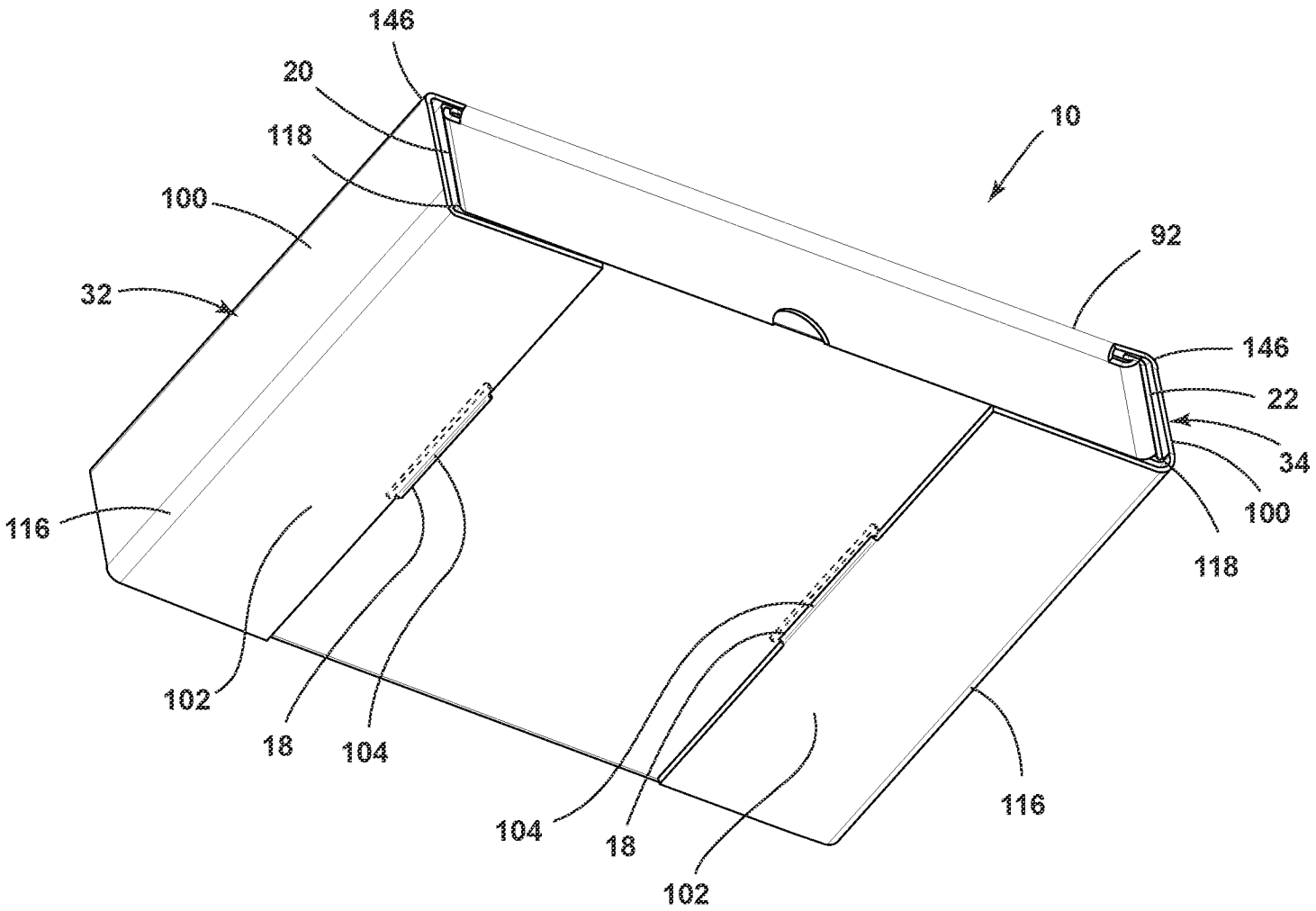
FIG. 13 is a bottom perspective view of reconfigurable packaging in a second configuration with side wings in a second folded position, according to the present disclosure.
Figure 14:
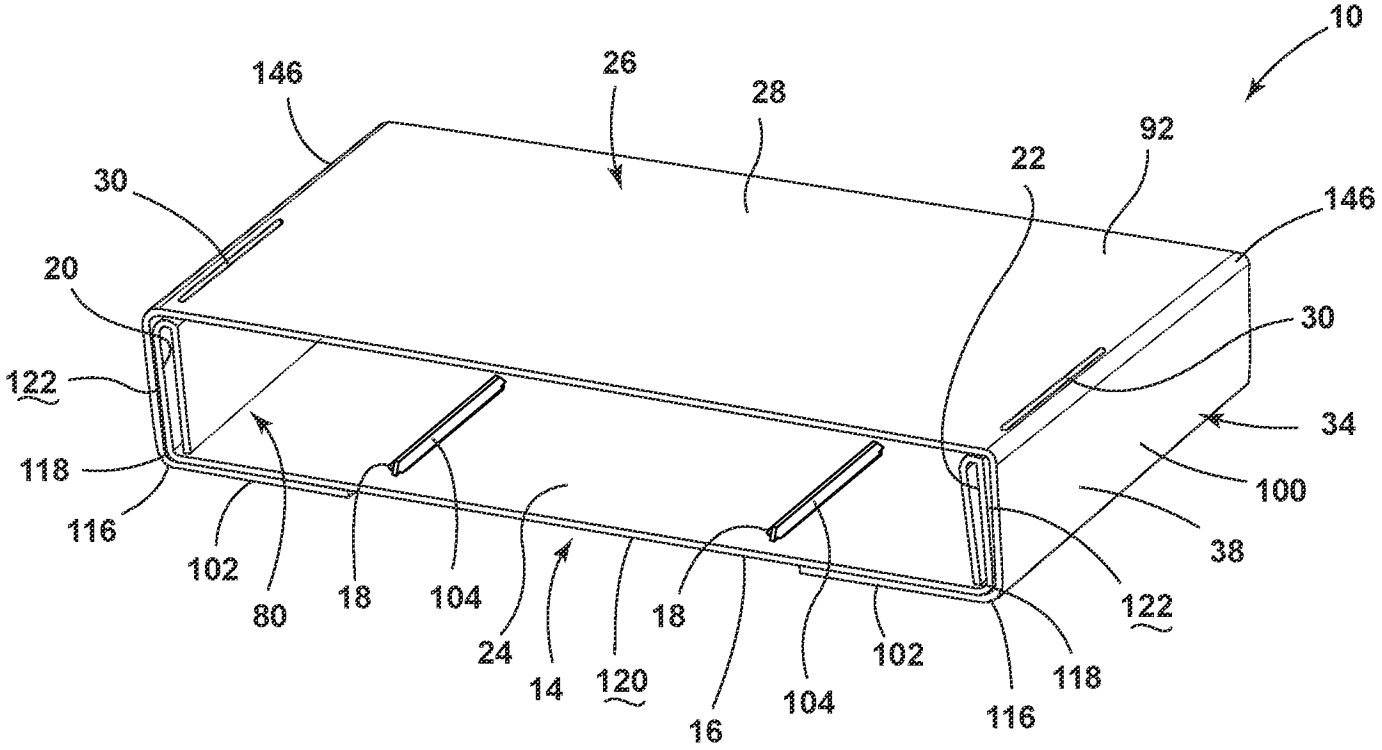
FIG. 14 is a top perspective cross-sectional view of the reconfigurable packaging of FIG. 12, taken at line XIV-XIV, according to the present disclosure

Referring to FIGS. 9 and 10, the cooking appliance 12 having the larger cooking cavity 56 is illustrated. The packaging 10 disposed within the cooking cavity 56 is in the first configuration 90 with the side wings 32, 34 in the first folded position 36. The increased width of the packaging 10 may be advantageous for use in the larger cooking cavity 56 to minimize or prevent movement of the packaging 10 during the shipping process.

The cooking cavity 50 is generally defined by a plurality of walls, with sidewalls 140, 142 each having a plurality of supports 144 to support a rack. The supports 144 may be integrally formed with the sidewalls 140, 142 (e.g., embossed) or may be a separate component selectively coupled to the sidewall 140, 142. The supports 144 on one sidewall 140 are aligned with the supports 144 on the opposing sidewall 142, and the supports 144 on each sidewall 140, 142 are disposed at substantially equal intervals along a height of the cooking cavity 50.

The packaging 10 extends from proximate one sidewall 140 to proximate the opposing sidewall 142. As best illustrated in FIG. 10, the first side wing 32 is illustrated proximate to the first sidewall 140. Though the first side wing 32 is illustrated, it is understood that the second side wing 34 is arranged in a mirrored configuration with the second sidewall 142. The first side wing 32 is disposed proximate to two adjacent supports 144 on the first sidewall 140 of the cooking cavity 50. The triangular shape of the first side wing 32 is advantageous for positioning the first side wing 32 relative to the supports 144. A corner 146 formed between the cover panel 28 and the connector portion 100 of the first side wing 32 is positioned between the two adjacent supports 144. By positioning the corner 146 between the two adjacent supports 144, additional movement of the packaging 10 within the cooking cavity 50 may be minimized or prevented.

Figure 15:
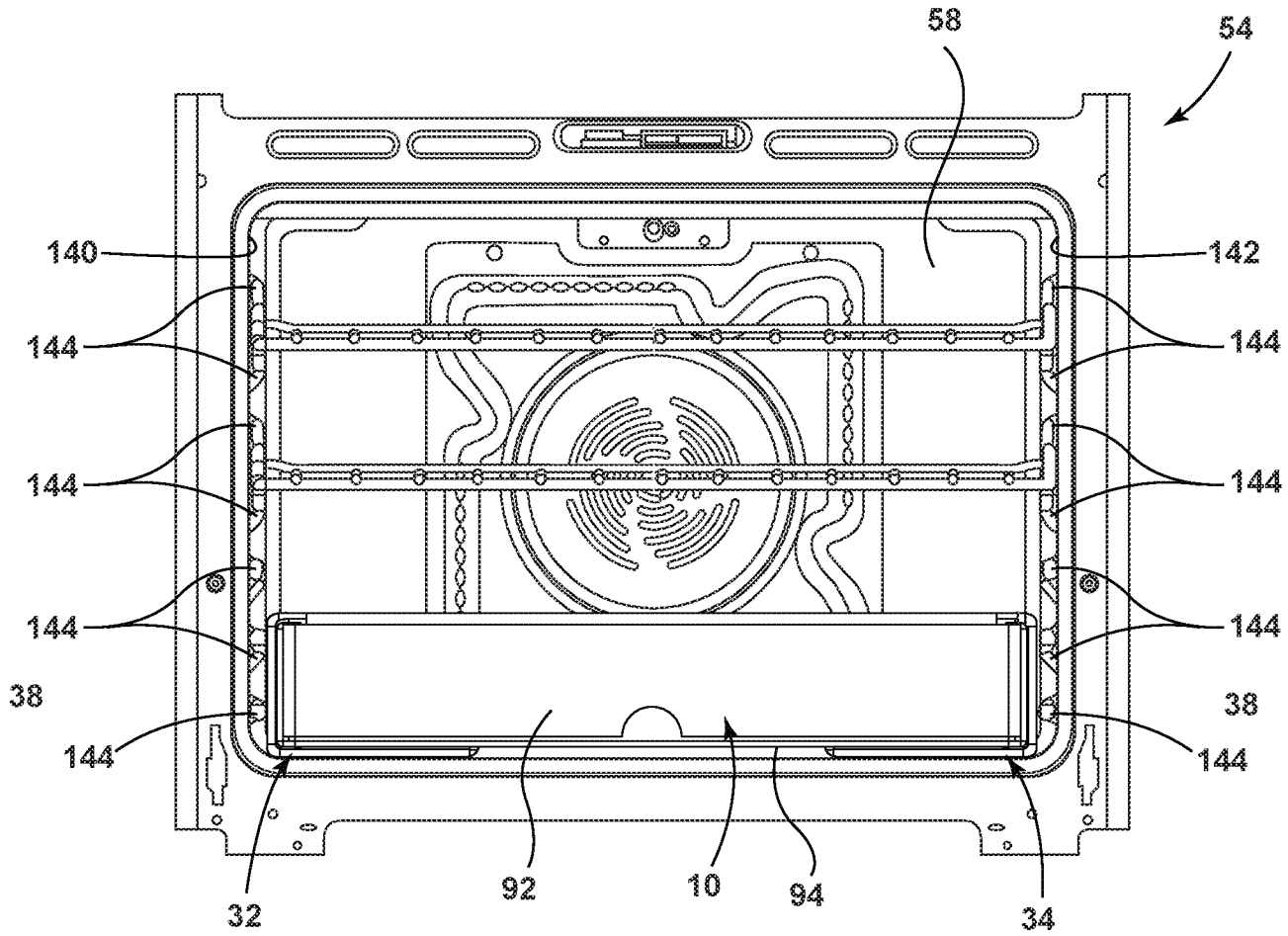
FIG. 15 is a front elevation view of reconfigurable packaging in a second configuration with side wings in a second folded position disposed within a cooking cavity, according to the present disclosure.

Referring again to FIGS. 11-14, the packaging 10 is illustrated in the second configuration 92 where the side wings 32, 34 are in the second folded position 38. The packaging 10 in the second configuration 92 has a lesser width than when the packaging 10 is in the first configuration 90 (FIGS. 3-10), which may be advantageous for the smaller cooking cavity 58 (FIG. 15).

The connector portions 100 and the engagement portions 102 of the side wings 32, 34 generally have a different configuration when in the second folded position 38. In the second configuration 92, the cover panel 28 is slightly wider than the sidewalls 140, 142. In this way, the cover panel 28 has a lesser width when the packaging 10 is in the second configuration 92 and, consequently, the side wings 32, 34 have an increased width relative to the first configuration 90. The corners 146 defined between the cover panel 28 and the side wings 32, 34 is closer to a center of the packaging 10 in the second configuration 92 than in the first configuration 90.

Generally, the cover panel 28 is wide enough to allow the connector portions 100 of the side wings 32, 34 to fold down and extend along the outer surfaces 122 of the sidewalls 20, 22 of the base 14. The corners 116 between the connector portions 100 and the engagement portions 102 are adjacent to or abutting the respective corner 118 between the sidewalls 20, 22 and the base panel 16.

When the cover 26 is closed, the engagement portions 102 extend along the bottom surface 120 of the base panel 16 toward the lower wing slots 18. Accordingly, the cover panel 28 and the side wings 32, 34 form general "C"-shaped configurations and the side wings 32, 34 match the shape of the sidewalls 20, 22 and the base panel 16. The distal tabs 104 are folded to extend at an angle or generally perpendicularly from the engagement portions 102 to extend into or through the lower wing slots 18 and into the storage cavity 24. In the second configuration 92 with the side wings 32, 34 in the second folded position 38, when the cover 26 is closed, approximately right angles are formed between the cover panel 28 and the connector portions 100, between the connector portions 100 and the engagement portions 102, and the engagement portions 102 and the distal tabs 104. It is contemplated that when the distal tabs 104 extend into the storage cavity 24, the accessories 60 (FIG. 2) may rest at least partially on distal tabs 104 within the storage cavity 24.

With reference now to FIG. 15, the cooking appliance 12 having the smaller cooking cavity 58 is illustrated, and the packaging 10 is illustrated within the cooking cavity 58. In the example illustrated in FIG. 15, the cooking cavity 58 is smaller than the cooking cavity 56 illustrated in FIG. 9. For example, the width of the cooking cavity 58 in FIG. 15 is less than the width of the cooking cavity 56 in FIG. 9. Accordingly, the smaller width of the packaging 10 in the second configuration 92 is advantageous for the smaller cooking cavity 58. The packaging 10 is inserted into the cooking cavity 50, resting on the bottom 94 of the cooking cavity 50, and the side wings 32, 34 are disposed proximate to the supports 144 on the sidewalls 140, 142.

Figure 16:
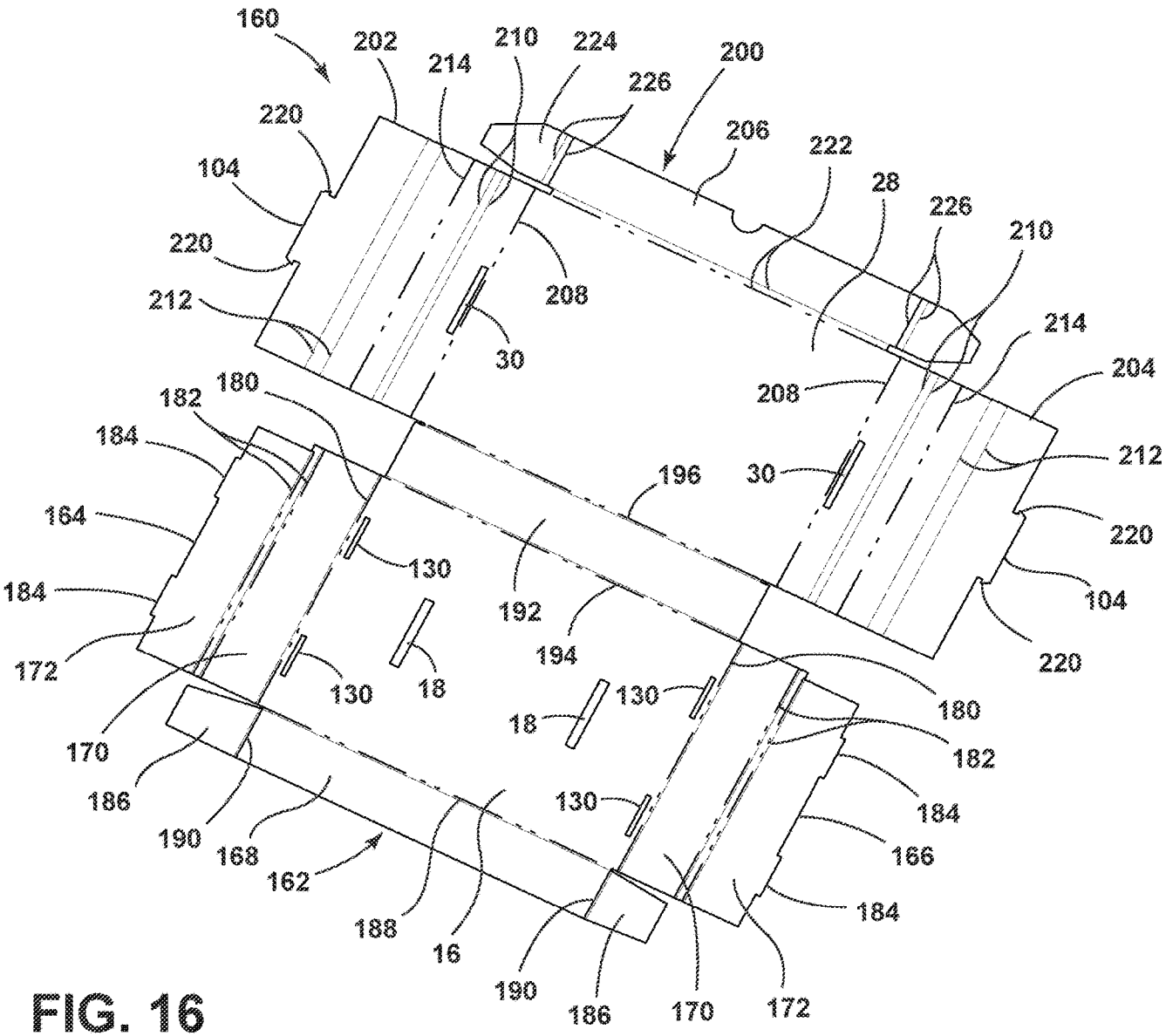
FIG. 16 is a top perspective view of a blank for forming reconfigurable packaging, according to the present disclosure.
Figure 17:
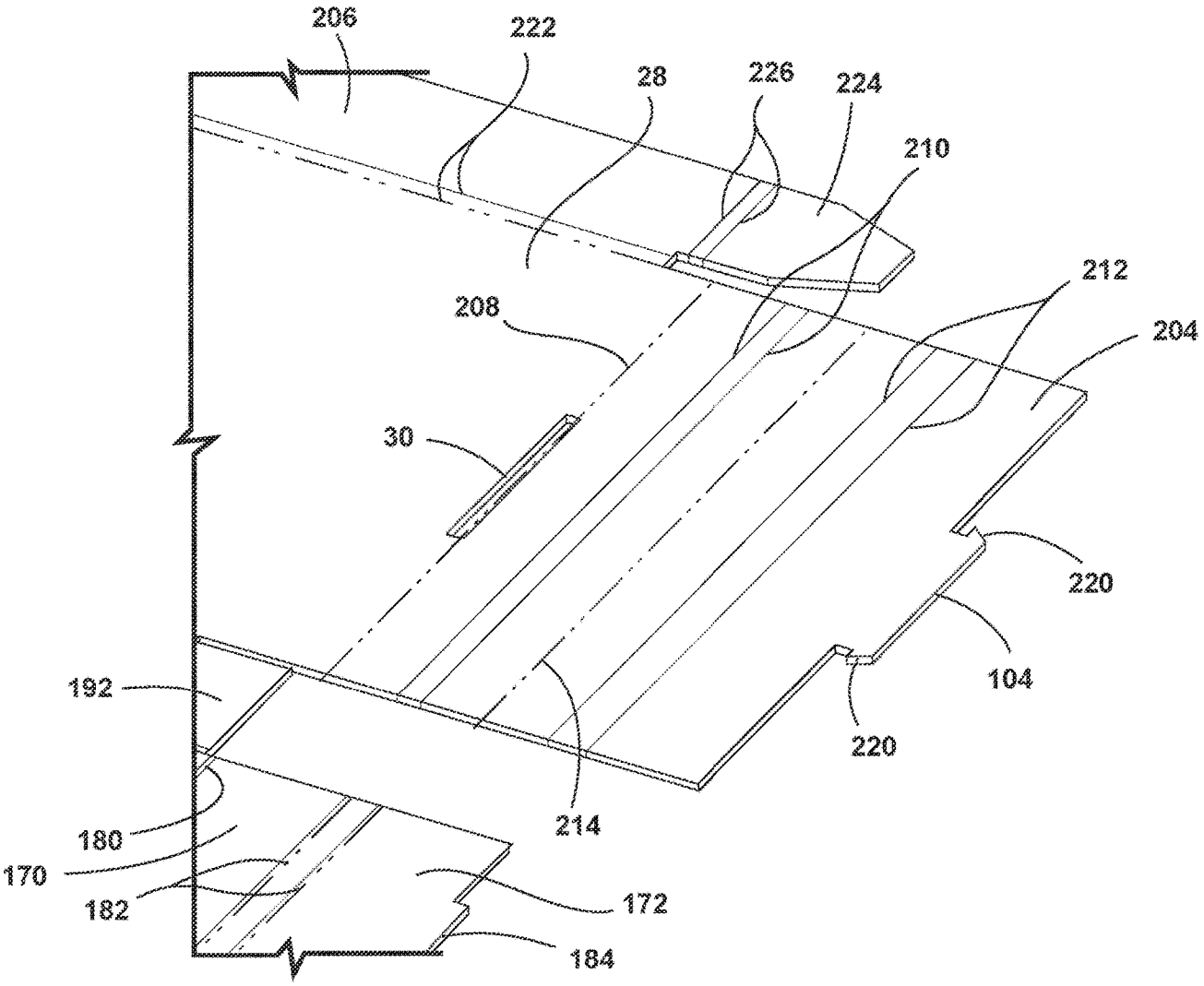
FIG. 17 is a partial enlarged top perspective view of the blank of FIG. 16, illustrated a wing having perforated lines and creases for folding the blank, according to the present disclosure.
Figure 18:
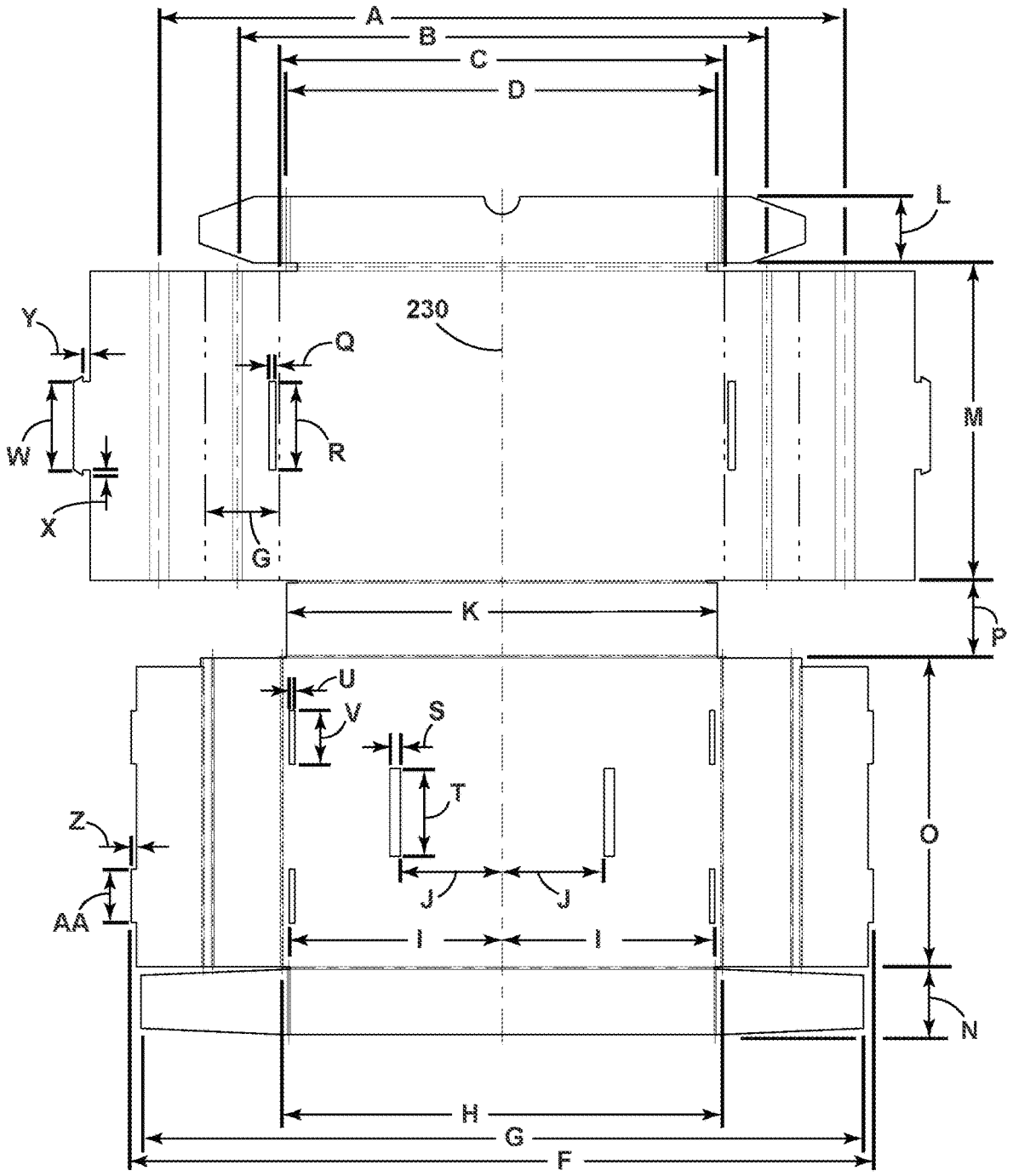
FIG. 18 is a top plan view of a blank for forming reconfigurable packaging, according to the present disclosure.

Referring to FIGS. 16-18, a blank 160 for forming the packaging 10 described herein is illustrated. The blank 160 is configured to form the reconfigurable packaging 10, which is adjustable to be folded between the first configuration 90 with the side wings 32, 34 in the first folded position 36 (e.g., the wider configuration) and the second configuration 92 with the side wings 32, 34 in the second folded position 38. This blank 160 may be advantageous for having the single blank 160, which forms the packaging 10 of two different sizes. Further, the packaging 10 may arrive at a manufacturing or shipping facility in one of the configurations of the packaging 10 and may be adjusted to the other configuration when utilized for the differently sized cooking appliances 12.

The blank 160 includes a base portion 162, which includes the base panel 16, side extensions 164, 166 that extend from opposing side edges of the base panel 16, and a front extension 168. In the illustrated example, the base panel 16 has a generally rectangular shape and defines the lower wing slots 18 (e.g., base wing slots) and multiple sidewall slots 130. As illustrated, two sidewall slots 130 are defined on the first side of the base panel 16 proximate to the first side extension 164, and two sidewall slots 130 are defined on the second side proximate to the second side extension 166. The sidewall slots 130 are substantially equidistant from the adjacent side extension 164, 166 and are aligned with the opposing sidewall slot 130. However, other configurations are contemplated without departing the teachings herein.

The side extensions 164, 166 are configured to form the sidewalls 20, 22 of the base 14 once folded. Each side extension 164, 166 includes a proximal portion 170, coupled to the base panel 16, and a distal portion 172, coupled to the proximal portion 170. The proximal portion 170 is configured to be folded to extend generally perpendicular from the base panel 16, and the distal portion 172 is configured to be folded to extend along the proximal portion 170 back toward the base panel 16. When folded, the distal portion 172 is disposed adjacent to the storage cavity 24 and the proximal portion 170 includes the outer surface 122 of the respective sidewall 20, 22. The distal portion 172 has a slightly narrower width than the proximal portion 170 to allow the distal portion 172, which may be advantageous for folding the side extensions 164, 166 into the sidewalls 20, 22.

In the illustrated configuration, an inner crease 180 is defined between each of the side extensions 164, 166 and the base panel 16. The inner creases 180 facilitate the folding of the side extensions 164, 166 relative to the base panel 16. Further, each side extension 164, 166 defines a pair of outer creases 182 between the proximal and distal portions 170, 172. The outer creases 182 extend parallel to one another on each side extension 164, 166 and generally facilitate forming a more rounded and increased fold angle (e.g., greater than 90°) between the proximal and distal portions 170, 172. The side extensions 164, 166 each include retaining tabs 184 extending from the distal portions 172. The retaining tabs 184 are configured to be inserted through the sidewall slots 130 to retain the side extensions 164, 166 in the folded configuration that forms the sidewalls 20, 22

Referring still to FIGS. 16-18, the base portion 162 also includes the front extension 168 with a crease 186 defined between the front extension 168 and the base panel 16. The crease 186 assists with folding the front extension 168 to extend generally perpendicular to the base panel 16 and form the front wall 82. The front extension 168 includes two insertion tabs 188, with one on each end of the front extension 168. The insertion tabs 188 are configured to be folded along creases 190 to extend perpendicularly from the folded front extension 168 over the base panel 16. Additionally, when the packaging 10 is being formed, the insertion tabs 188 are configured to be disposed between the proximal and distal portions 170, 172 of the folded sidewalls 20, 22. In the illustrated example, the insertion tabs 188 extend to proximate to the inner creases 180 to an end of the adjacent side extension 164, 166. Inner edges of the insertion tabs 188 are angled, which may be advantageous for folding the insertion tabs 188 within the sidewalls 20, 22 and retaining the front extension 168 in the folded position to form the front wall 82.

A connector portion 192 of the blank 160 extends between the base panel 16 and the cover panel 28. The connector portion 192 is configured to form the rear wall 84 when packaging 10 is formed. A crease 194 is defined between the base panel 16 and the connector portion 192, and a crease 196 between the connector portion 192 and the cover panel 28. The creases 194, 196 assist with folding the connector portion 192 to form the rear wall 84 and folding the cover panel 28 to enclose the storage cavity 24, respectively.

With reference again to FIGS. 16-18, the blank 160 includes a cover portion 200, which forms the cover 26 of the packaging 10 when the packaging 10 is formed. The cover portion 200 includes the cover panel 28, wing flaps 202, 204, and a retaining flap 206. The cover panel 28 defines the upper wing slots 30 (e.g., cover wing slots) adjacent to or along inner perforated lines 208 between the cover panel 28 and the wing flaps 202, 204, respectively.

The cover portion 200 includes multiple creases and multiple perforated lines. Each wing flap 202, 204 includes creases 210, 212 and an outer perforated line 214. The inner pair of creases 210 is disposed proximate to the inner perforated lines 208 and the outer pair of creases 212 is disposed between the outer perforated lines 214 and the distal tabs 104.

The inner creases 210 generally separate the wing flaps 202, 204 from the cover panel 28 for the first folded position 36. The inner perforated lines 208 proximate to the upper wing slots 30 generally separate the cover panel 28 from the wing flaps 202, 204 for the second folded position 38. Accordingly, an area or space between each inner perforated line 208 and the adjacent inner crease 210 may be included as part of the cover panel 28 when the side wings 32, 34 are in the first folded position 36 and may be included as part of the side wings 32, 34 when the side wings 32, 34 are in the second folded position 38. The perforated lines 208, 214 and creases 210, 212 assist in allowing the side wings 32, 34 to be reconfigured between the first and second folded positions 36, 38.

Referring still to FIGS. 16-18, the distal tabs 104 include locking features 220, which are configured to be wider than the lower and upper wing slots 18, 30. This configuration allows the locking features 220 to engage at least one of the cover panel 28 and the base panel 16 to retain the side wings 32, 34 in the selected folded position 36, 38. The distal tabs 104 are centrally located on each wing flap 202, 204 and are configured on the wing flaps 202, 204 to engage each of the upper wing slots 30 and the lower wing slots 18.

The cover portion 200 also includes the retaining flap 206. The retaining flap 206 extends from an edge of the cover panel 28 opposite the connector portion 192. A pair of creases 222 is defined between the cover panel 28 and retaining flap 206 to assist in the folding of the retaining flap 206 generally perpendicular to the cover panel 28 to form the front coupling insert 86. The retaining flap 206 includes opposing insertion features 224, which extend from proximate the inner perforated lines 208 to proximate the outer perforated line 214, respectively.

The insertion features 224 generally taper, which assists when the front coupling insert 86 is holding the cover 26 in the closed position. The insertion features 224 extend generally perpendicularly to the retaining flap 206, when folded along a crease 226 and when the packaging 10 is in the closed position. The retaining flap 206 and the insertion tabs 188 are configured to be disposed within the storage cavity 24 and extend along the front wall 82 and the sidewalls 20, 22, respectively, when the packaging 10 is formed and closed.

With reference still to FIGS. 16 and 18, the blank 160 in the illustrated example has various dimensions allowing the packaging 10 to be formed and adjusted between the first and second configurations 90, 92. The configuration illustrated in FIG. 18 has specified exemplary dimensions. For example, a width A between the outer perforated lines 214 on the wing flaps 202, 204 is between 750 mm and 850 mm. A width B between centers of the pair of inner creases 210 on the wing flaps 202, 204 is between 550 mm to 650 mm. A width C between the inner perforated lines 208 is between 450 mm and 550 mm. A width D between the inner perforated lines 208 defined between the retaining flap 206 and the insertion tabs 188 is between 440 mm and 540 mm. A width E between the inner and outer perforated lines 214 on each wing flap is between 50 mm and 120 mm.

A width F between ends of the retaining tabs 184 of the side extensions 164, 166 is between 800 mm and 900 mm. A width G between ends of the side extensions 164, 166 (excluding the retaining tabs 184) is between 750 mm and 850 mm. A width H between the inner creases 210 defined between the side extensions 164, 166 and the base panel 16 is between 450 mm and 550 mm. A width I between an inner edge of each sidewall slot 130 and a central axis 230 is between 175 mm and 275 mm. Further, a width J between an inner edge of each lower wing slot 18 and the central axis 230 is between 75 mm and 175 mm. A width K of the connector portion 100 is between 425 mm and 525 mm.

Further, a length L of the retaining flap 206 is between 50 mm and 150 mm. A length M of the cover panel 28 and the wing flaps 202, 204 is between 300 mm and 400 mm. A length N of the front extension 168 is between 25 mm and 125 mm. A length O of the base panel 16 and the proximal portions 170 of the side extensions 164, 166 is between 300 mm and 400 mm. A length P of the connector portion 192 is between 25 mm and 125 mm.

Additionally, referring still to FIG. 18, the upper wing slots 30 may each have a width Q between 5 mm and 15 mm and a length R between 50 mm and 150 mm. The lower wing slots 18 may each have a width S between 5 mm and 20 mm and a length T between 50 mm and 150 mm. The sidewall slots 130 may each have a width U between 2 mm and 15 mm and a length V between 40 mm and 80 mm.

Each distal tab 104 may have a length W between 50 mm and 150 mm. Each locking feature 220 of the distal tabs 104 may have a length X between 2 mm and 10 mm and be spaced from an end of the respective wing flap 202, 204 by a distance Y between 2 mm and 15 mm. Each retaining tab 184 may extend a distance Z from the respective side extension 164, 166 between 2 mm and 100 mm and may have a length AA between 25 mm and 125 mm. The dimensions disclosed herein are merely exemplary and are not meant to be limiting. The blank 160 may have any practicable dimensions for forming the first and second configurations 90, 92 described herein.

Referring still to FIG. 18, the central axis 230 extends through the cover portion 200, the connector portion 192, and the base portion 162. The lower wing slots 18 are generally defined closer to the central axis 230 compared to the upper wing slots 30. The lower wing slots 18 are also defined closer to the central axis 230 than the sidewall slots 130. Generally, a first side of the blank 160 is a mirror image of a second side across the central axis 230. It is contemplated that each crease may be multiple creases and each pair of creases may be a single crease. Further, it is also contemplated that each crease may be a perforated line and each perforated line may be a crease. Moreover, creases appearing in pairs may be advantageous for greater fold angles (e.g., over 90°) compared to single creases (e.g., less than or equal to 90°). The pairs of creases may also be advantageous for providing more rounded corners than single creases.

Figure 19:
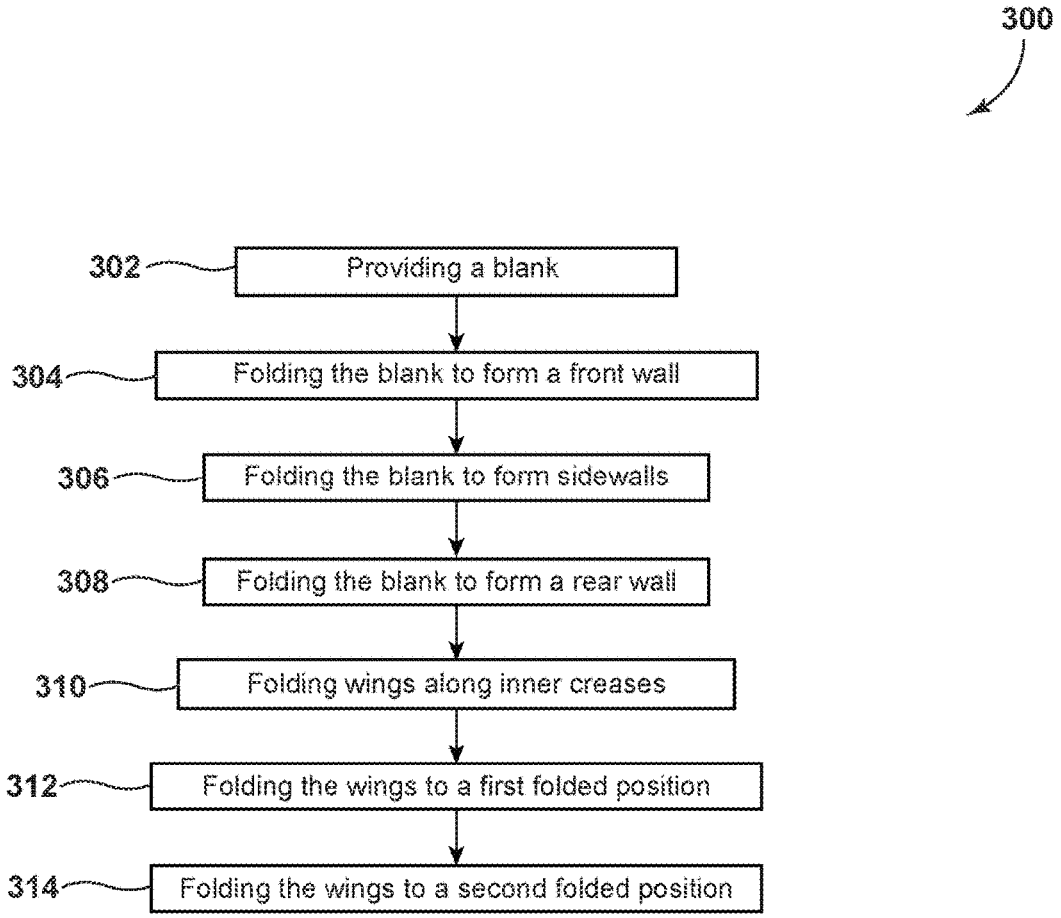
FIG. 19 is a flow chart of a method of adjusting a packaging size, according to the present disclosure.

With reference now to FIG. 19, as well as FIGS. 1-18, a method 300 for adjusting a size of the packaging 10 includes step 302 of providing the blank 160 as described herein. The step 302 may include forming the blank 160 with various manufacturing processes to cut the blank 160 to specific dimensions, forming the perforated lines, and forming the creases. Typically, the blank 160 is formed from corrugated cardboard material, plastic material, foam material, etc. In cardboard examples, the cardboard may be punctured to form the perforations and may be pressed to form the creases.

In step 304, the blank 160 is folded along the crease 186 defined between front extension 168 and the base panel 16. The front extension 168 is folded along the creases 190 to extend generally perpendicular to the base panel 16. Further, in step 304, the insertion tabs 188 are folded along the creases to extend generally perpendicular from the front extension 168 and over the base panel 16.

In step 306, the blank 160 is folded to form the sidewalls 20, 22 of the base 14. The side extensions 164, 166 are folded along the inner creases 180 to extend substantially perpendicular to the base panel 16 in the same direction as the front extension 168. The side extensions 164, 166 are also folded along the outer creases 182 over the base panel 16 to allow the distal portions 172 to abut the proximal portions 170. Generally, the insertion tabs 188 of the front extension 168 are disposed between the proximal portions 170 and the distal portions 172 as the distal portions 172 are folded, thereby retaining the front wall 82 in the folded position. The retaining tabs 184 are inserted into the sidewall slots 130 defined in the base panel 16 to retain the side extensions 164, 166 in the folded configuration, forming the sidewalls 20, 22 of the base 14.

In step 308, the blank 160 may be folded to form the rear wall 84. The blank 160 is folded along the crease 194 between the base panel 16 and the connector portion 100. In step 310, the blank 160 is folded to form the cover 26. The blank 160 is folded along the crease 194 between the cover panel 28 and the connector portion 192. The cover panel 28 may be moved toward the front wall 82. Additionally, in step 308, the blank 160 is folded along the crease 222 between the retaining flap 206 and the cover panel 28 and the creases 226 between the retaining flap 206 and the insertion features 224. The retaining flap 206 extends generally perpendicularly from the cover panel 28 toward the base panel 16. The insertion features 224 are folded generally perpendicular to the retaining flap 206 along the interior surface 106 of the cover panel 28 to form the front coupling insert 86. The front coupling insert 86 is inserted into the storage cavity 24 and abut the inner surfaces of the base 14 to retain the cover 26 in the closed position, enclosing the storage cavity 24.

In step 310, the side wings 32, 34 are folded along the inner crease 210 such that the connector portions 100 of the side wings 32, 34 extend at the acute angle $\alpha$ toward the corner 118 defined by the adjacent sidewall 20, 22 and the base 14. In step 312, the engagement portions 102 are folded along the outer creases 212 such that the engagement portions 102 extend vertically and parallel with the sidewalls 20, 22 toward the cover panel 28. The engagement portions 102 extend at the acute angles $\beta$ relative to the connector portions 100. The side wings 32, 34 are folded inward toward the sidewalls 20, 22 such that the engagement portions 102 are disposed interior of the connector portions 100 and disposed between the connector portions 100 and the sidewalls 20, 22.

Additionally, in step 312, the distal tabs 104 are inserted into or through the upper wing slots 30 of the cover panel 28. The locking features 220 engaging the cover panel 28 retain the side wings 32, 34 in the first folded position 36 and, consequently, retain the packaging 10 in the first configuration 90. The side wings 32, 34 are folded to form the triangular shapes adjacent to the sidewalls 20, 22, increasing the width of the packaging 10.

In step 314, the distal tabs 104 are removed or disengaged from the upper wing slots 30 and partially unfolded. The side wings 32, 34 may then be folded along the inner perforated lines 208 such that the engagement portions 102 extend generally perpendicular from the cover panel 28 and parallel with the sidewalls 20, 22. Further in step 314, the side wings 32, 34 are folded along the outer perforated lines 214, allowing the engagement portions 102 to extend generally parallel to the base panel 16 and generally perpendicular to the connector portions 100.

The engagement portions 102 extend along, about, or abut the bottom surface 120 of the base panel 16. The distal tabs 104 may be folded to extend generally perpendicularly from the engagement portions 102 and inserted into or through the lower wing slots 18 into the storage cavity 24. The locking features 220 of the distal tabs 104 engage the base panel 16 to retain the side wings 32, 34 in the second folded configuration and, consequently, the packaging 10 in the second configuration 92. The side wings 32, 34 abut the outer surfaces 122 of the sidewalls 20, 22 and the bottom surface 120 of the base panel 16, thereby decreasing the width of the packaging 10. It will be understood that the steps of the method 300 may be performed in any order, simultaneously, and/or omitted without departing from the teachings provided herein.

Referring to FIGS. 1-19, the single blank 160 disclosed herein may be reconfigured into the first configuration 90, where the side wings 32, 34 are in the first folded position 36, and the second configuration 92, where the side wings 32, 34 are in the second folded position 38. In this way, the same blank 160 may be used to package the accessories 60 for cooking appliances 52, 54 having different cooking cavities 56, 58. In a non-limiting example, the cooking appliance 52 illustrated in FIG. 9 is an approximately 30-inch cooking appliance 52 with the larger cooking cavity 56, whereas the cooking appliance 54 in FIG. 15 has an approximately 27-inch cooking appliance 54 with the smaller cooking cavity 58. The reconfigurable packaging 10 can be used to store the accessories 60 in each of the 30-inch and the 27-inch cooking appliances 52, 54 by folding the side wings 32, 34 into the different folded positions 36, 38. The side wings 32, 34 may be folded and adjusted into the first folded position 36, forming the triangular shapes, to form the packaging 10 with the first wider width. This wider configuration allows the packaging 10 to extend from one sidewall 140, 142 to the other in the larger cooking cavity 56.

In the smaller cooking cavity 58, the packaging 10 may be adjusted to the second configuration 92, where the side wings 32, 34 are in the second folded position 38, having the second smaller width. The lesser width is advantageous for inserting the packaging 10 into the smaller cooking cavity 58 and having the packaging 10 extend from the first sidewall 140 to the second sidewall 142. The packaging 10 may be folded into the first configuration 90 and adjusted to the second configuration 92, or vice versa, depending on which cooking appliance 12 is being utilized or shipped. Further, it is contemplated that one side wing 32 may be adjusted into the first folded position 36 and the second side wing 34 may be in the second folded position 38 to provide a third middle width for the packaging 10.

Once the blank 160 is at least partially folded to form the storage cavity 24, the accessories 60 may be disposed on the base panel 16 in the storage cavity 24. The side wings 32, 34 may be folded to the selected folded position 36, 38 or unfolded and then re-folded into the selected folded position 36, 38 based on the cooking appliance 12. The front coupling insert 86 may be inserted into the storage cavity 24 to close the cover. The packaging 10 may then be inserted into the cooking appliance 12 to continue with the packaging and shipping process.

Use of the present device may provide for a variety of advantages. For example, the same blank 160 may be utilized with cooking cavities 50 of different sizes to protect the accessories 60 during the shipping process. Additionally, the side wings 32, 34 may be adjusted between the first folded position 36 and the second folded position 38, providing two different widths for the packaging 10. Further, the blank 160 may reduce manufacturing and production costs by reducing a number of items utilized for the shipping process. Additional benefits or advantages may be realized and/or achieved.

The device disclosed herein is further summarized in the following paragraphs and is further characterized by combinations of any and all of the various aspects described therein.

According to at least one aspect, reconfigurable packaging for a cooking appliance includes a base including a base panel defining lower wing slots and opposing sidewalls extending from the base panel. The base defines a storage cavity. A cover is coupled to the base and configured to enclose the storage cavity. The cover includes a cover panel defining upper wing slots, a first side wing extending from a first side of the cover panel, and a second side wing extending from a second side of the cover panel. The first side wing and the second side wing are operable between a first folded position engaging the upper wing slots and a second folded position engaging the lower wing slots.

According to another aspect, a cover defines a first width when first and second side wings are in a first folded position and a second width when the first and second side wings are in a second folded position. The second width is less than the first width.

According to another aspect, first and second side wings each have a connector portion that extends from the cover panel and an engagement portion that includes a distal tab. At least one of a crease and a perforated line is defined between the connector portion and the engagement portion.

According to another aspect, each connector portion extends at an acute angle relative to an interior surface of a cover panel and toward a base panel. The engagement portions extend proximate to sidewalls for distal tabs to extend into upper wing slots when first and second side wings are in a first folded position.

According to another aspect, first and second side wings each form a triangular shape proximate to one sidewall when in a first folded position.

According to another aspect, connector portions extend proximate to sidewalls toward a base panel. Engagement portions extend along a bottom surface of the base panel for distal tabs to extend into lower wing slots when first and second side wings are in a second folded position.

According to another aspect, at least one of a tray and a basket is disposed within the storage cavity.

According to another aspect, a blank for reconfigurable packaging includes a base portion configured to form a base of the reconfigurable packaging. The base portion includes a base panel defining sidewall slots and base wing slots, a first side extension extending from a first side of the base panel, and a second side extension extending from a second opposing side of the base panel. A cover portion is configured to form a cover of the reconfigurable packaging. The cover portion includes a cover panel defining cover wing slots, a first wing flap extending from a first side of the cover panel and including a first distal tab, and a second wing flap extending from a second side of the cover panel and including a second distal tab. Each of the first wing flap and the second wing flap are configured to be folded into a first folded position along at least one of a crease and a perforated line for the distal tabs to engage the cover wing slots and a second folded position along at least one of a crease and a perforated line for the first and second distal tabs to engage the base wing slots. A connector portion coupling the base panel and the cover panel.

According to another aspect, a first side extension and a second side extension each include a proximal portion and a distal portion. The distal portion has a width less than a width of the proximal portion. Each distal portion includes retaining tabs configured to be inserted into sidewall slots.

According to another aspect, each cover wing slot is disposed at least one of adjacent to and along a perforated line.

According to another aspect, base wing slots include a first base wing slot defined on a first side of a base panel and aligned with a second base wing slot defined on a second side of the base panel.

According to another aspect, sidewall slots include two first sidewall slots defined on a first side of a base panel and two second sidewall slots defined on a second side of the base panel. A first base wing slot is centrally located between the two first sidewall slots, and a second base wing slot is centrally located between the two second sidewall slots.

According to another aspect, a first side of a blank is a mirror image of a second side over a central axis.

According to another aspect, base wing slots are defined closer to a central axis compared to cover wing slots.

According to another aspect, each of a first wing flap and a second wing flap includes a perforated line disposed between creases.

According to another aspect, a method for adjusting a packaging size providing a blank, folding the blank to form sidewalls of a base, folding the blank to form a cover configured to enclose a storage cavity formed by the base, folding side wings of the cover toward the base, folding the side wings into a first folded position where engagement portions of the side wings extend toward the cover to insert distal tabs in upper wing slots defined by the cover to define a first width of a packaging, and folding the side wings into a second folded position where the engagement portions of the side wings extend along a bottom surface of the base to insert the distal tabs in base wing slots defined by the base to define a second width of the packaging.

According to another aspect, a second width of a packaging is less than a first width.

According to another aspect, a step of folding side wings into a first folded position includes forming triangular shapes adjacent to sidewalls of a base.

According to another aspect, a step of providing a blank includes forming a plurality of creases and a plurality of perforated lines in the blank.

According to another aspect, a step of folding side wings into a second folded position includes folding engagement portions of the side wings to extend along outer surfaces of sidewalls.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. Packaged appliances, comprising:

a first cooking appliance defining a first cooking cavity of a first size;

a second cooking appliance defining a second cooking cavity of a second size, the second size being less than the first size, wherein each of the first cooking appliance and the second cooking appliance includes:

a first sidewall with first rack supports coupled thereto; and a second sidewall with second rack supports coupled thereto; and reconfigurable packaging defining a storage cavity, wherein the reconfigurable packaging includes:

a base defining lower wing slots;

a cover coupled to the base and defining upper wing slots;

a first side wing extending from the cover in a first direction; and a second side wing extending from the cover in a second direction, wherein the first side wing and the second side wing are operable between a first folded position engaging the upper wing slots and a second folded position engaging the lower wing slots, wherein the first and second side wings are disposed in the first folded position to define a first width to be positioned within the first cooking cavity and in the second folded position to define a second lesser width to be positioned within the second cooking cavity.

2. The packaged appliances of claim 1, wherein a corner of the first side wing is disposed between adjacent ones of the first rack supports and a corner of the second side wing is disposed between adjacent ones of the second rack supports when the reconfigurable packaging is in the first cooking appliance.

3. The packaged appliances of claim 1, wherein the base is configured to be disposed on a bottom within the first cooking cavity.

4. The packaged appliances of claim 1, wherein each of the first and second side wings forms a triangular shape in the first folded position, the triangular shape of the first side wing being on an opposing side of the base from the triangular shape of the second side wing.

5. The packaged appliances of claim 1, wherein a connector portion of the first side wing is disposed adjacent to the first rack supports and a connector portion of the second side wing is disposed adjacent to the second rack supports when the reconfigurable packaging is in the second cooking appliance.

6. The packaged appliances of claim 1, wherein an engagement portion of each of the first side wing and the second side wing are configured to be disposed on a bottom in the second cooking cavity.

7. The packaged appliances of claim 1, wherein the reconfigurable packaging is constructed of corrugated cardboard.

8. The packaged appliances of claim 1, further comprising:

a cooking accessory disposed within the storage cavity of the reconfigurable packaging.

9. A packaged appliance assembly, comprising:

at least one cooking appliance;

reconfigurable packaging defining a storage cavity and positioned within the at least one cooking appliance, wherein the reconfigurable packaging includes:

a base defining lower wing slots;

a cover coupled to the base and defining upper wing slots;

a first side wing extending from the cover in a first direction; and a second side wing extending from the cover in a second direction, wherein the first side wing and the second side wing are operable between a first folded position engaging the upper wing slots and a second folded position engaging the lower wing slots based on a size of the at least one cooking appliance; and an appliance accessory disposed within the storage cavity.

10. The packaged appliance assembly of claim 9, wherein the at least one cooking appliance defines a cooking cavity, and wherein the reconfigurable packaging is disposed in a horizontal position on a bottom of the cooking cavity.

11. The packaged appliance assembly of claim 9, wherein the at least one cooking appliance includes a first sidewall and a second sidewall at least partially defining a cooking cavity, and wherein the first side wing is disposed adjacent to the first sidewall and the second side wing is disposed adjacent to the second sidewall.

12. The packaged appliance assembly of claim 9, wherein the at least one cooking appliance includes a first cooking appliance defining a first cooking cavity of a first size and a second cooking appliance defining a second cooking cavity of a second size, the second size being less than the first size.

13. The packaged appliance assembly of claim 12, wherein the first and second side wings are disposed in the first folded position to define a first width to be positioned within the first cooking cavity and in the second folded position to define a second lesser width to be positioned within the second cooking cavity.

14. The packaged appliance assembly of claim 9, wherein the reconfigurable packaging defines a first width when the first and second side wings are in the first folded position and a second lesser width when the first and second side wings are in the second folded position.

15. The packaged appliance assembly of claim 14, wherein the first and second side wings define triangular shapes adjacent to sidewalls of the base when in the first folded position, and wherein the first and second side wings extend along the sidewalls of the base and along a bottom surface of the base in the second folded position.

16. A packaged appliance, comprising:

a body defining a cavity between a first sidewall and a second sidewall;

reconfigurable packaging disposed on a bottom of the cavity, wherein the reconfigurable packaging extends from adjacent to the first sidewall to adjacent to the second sidewall in a horizontal position, the reconfigurable packaging including:

a base defining lower wing slots;

a cover coupled to the base and defining upper wing slots, the base and the cover defining a storage cavity;

a first side wing extending from a first side of the cover; and a second side wing extending from a second opposing side of the cover, wherein the first side wing and the second side wing are operable between a first folded position engaging the upper wing slots to define a first width and a second folded position engaging the lower wing slots to define a second lesser width based on a width of the cavity; and at least one accessory disposed within the storage cavity.

17. The packaged appliance of claim 16, wherein each of the first side wing and the second side wing includes a connector portion, an engagement portion, and a distal tab, wherein the connector portions extend at acute angles relative to the cover and toward the base, the engagement portions extend proximate to the base and toward the cover, and the distal tabs extend into the upper wing slots when the first and second side wings are in the first folded position.

18. The packaged appliance of claim 16, wherein each of the first side wing and the second side wing includes a connector portion, an engagement portion, and a distal tab, wherein the connector portions extend toward a bottom surface of the base, the engagement portions extend along the bottom surface of the base, and the distal tabs extend into the lower wing slots when the first and second side wings are in the second folded position.

19. The packaged appliance of claim 16, further comprising:

an insert disposed within the storage cavity, wherein the at least one accessory includes a tray and a basket, and wherein the insert is disposed between the tray and the basket.

20. The packaged appliance of claim 16, wherein the reconfigurable packaging includes a coupling insert extending from the cover, and wherein the coupling insert is disposed in the storage cavity and abutting the base to enclose the storage cavity.

* * * * *